US011526097B2

(12) United States Patent
Kumagai et al.

(10) Patent No.: US 11,526,097 B2
(45) Date of Patent: Dec. 13, 2022

(54) IMAGE FORMING APPARATUS

(71) Applicant: CANON KABUSHIKI KAISHA, Tokyo (JP)

(72) Inventors: Kenzo Kumagai, Hachioji (JP); Kazuhiro Akiba, Nagareyama (JP); Yuichiro Maeda, Kashiwa (JP); Yohei Gamo, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/903,432

(22) Filed: Jun. 17, 2020

(65) Prior Publication Data

US 2020/0409288 A1 Dec. 31, 2020

(30) Foreign Application Priority Data

Jun. 28, 2019 (JP) ..... JP2019-120819
Apr. 10, 2020 (JP) ..... JP2020-070947

(51) Int. Cl.
*G03G 15/08* (2006.01)

(52) U.S. Cl.
CPC ..... *G03G 15/0877* (2013.01)

(58) Field of Classification Search
None
See application file for complete search history.

(56) References Cited

U.S. PATENT DOCUMENTS

| | | | | |
|---|---|---|---|---|
| 8,509,651 | B2 | 8/2013 | Tsukijima | |
| 10,732,539 | B2 | 8/2020 | Katayama et al. | |
| 2017/0315470 | A1* | 11/2017 | Mochizuki | G03G 21/1638 |
| 2017/0315501 | A1* | 11/2017 | Mochizuki | G03G 15/5016 |
| 2020/0310336 | A1 | 10/2020 | Gamo | |

FOREIGN PATENT DOCUMENTS

JP 2011-59296 A 3/2011

* cited by examiner

*Primary Examiner* — Jas A Sanghera
(74) *Attorney, Agent, or Firm* — Venable LLP

(57) ABSTRACT

An image forming apparatus includes an attachment portion, an attachment detection unit, an output portion, a first cover, a first detection portion, a second cover, and a control unit. A control unit is configured to control opening movement of the first cover to open the first cover linked with movement that the second cover is opened when the output portion outputs information of replacing the developer accommodating container. After the first detection portion detects that the first cover is in a closed state after the first cover has been opened based on information output by the output portion, the first detection portion detects whether the developer accommodating container is attached to the attachment portion or not, and if the first detection portion detects that the developer accommodating container is not attached to the attachment portion, the control unit controls the first cover to open.

45 Claims, 24 Drawing Sheets

IMAGE FORMING APPARATUS

BACKGROUND OF THE INVENTION

Field of the Invention

The present invention relates to an image forming apparatus.

Description of the Related Art

As an image forming apparatus of an electrophotographic system, the image forming apparatus in which a toner is filled in a developer accommodating container (hereinafter referred to as a toner container) which is disposed in an attachable and detachable manner to and from an apparatus body is widely used in the market. In general, in a case where a residual quantity of the toner in the toner container is lessened and it becomes unable to supply a desired quantity of the toner to a developing unit, a control unit provides a message on a display to urge a user to replace the toner container and notifies the user that the time has come to replace the toner container.

Further, as the image forming apparatus, different from a front cover (a second cover) disposed at a front face of the apparatus body, a configuration to dispose a small door (a first cover), by which each of insertion slots of toner containers is made openable and closable, inside the front cover is suggested (Japanese Patent Laid-Open No. 2011-59296). In this suggested image forming apparatus, when the user opens the front cover in accordance with a displayed replacement message after the toner in the toner container has been lessened, only the small door corresponding to the toner container whose toner has been lessened is automatically opened. When the user has replaced the toner container, and has closed the small door and then the front cover, the toner is supplied to the apparatus body from a replaced toner container. To be noted, in a case where the toner container has been unattached, the message is displayed, and an image formation is not performed until the toner container is attached.

However, in the image forming apparatus disclosed in Japanese Patent Laid-Open No. 2011-59296 described above, in a case where the toner container is unattached, the display of the message about an unattachment of the toner container is provided after the small door and the front cover have been closed. Thus, the user then finds out the unattachment of the toner container, and thereafter needs to carry out complicated works, i.e. opening the front cover by hands, waiting for the small cover to open automatically, and attaching a new toner container to the apparatus body.

The present invention provides the image forming apparatus which improves an operability in a case where the toner container is unattached at the replacement of the toner container.

SUMMARY OF THE INVENTION

According to a first aspect of the present invention, an image forming apparatus includes an attachment portion which is provided in the image forming apparatus and to which a developer accommodating container configured to accommodate a developer is detachably attached, an attachment detection unit configured to detect whether the developer accommodating container is attached to the attachment portion, an output portion configured to output information of replacing the developer accommodating container, a first cover disposed at the attachment portion and configured to be opened to an open state where the developer accommodating container is attachable to and detachable from the attachment portion and closed to a closed state where the developer accommodating container is not attachable to nor detachable from the attachment portion, a first detection portion configured to detect the open state and the closed state of the first cover, a second cover configured to be opened to an open state where the first cover is exposed in an openable and closable manner and closed to a closed state where the first cover is covered, and a control unit configured to control opening movement of the first cover to open the first cover linked with movement that the second cover is opened when the output portion outputs the information of replacing the developer accommodating container. After the first detection portion detects that the first cover is in the closed state after the first cover has been opened based on the information output by the output portion, the first detection portion detects whether the developer accommodating container is attached to the attachment portion or not, and if the first detection portion detects that the developer accommodating container is not attached to the attachment portion, the control unit controls the first cover to open.

According to a second aspect of the present invention, an image forming apparatus includes a developer accommodating container configured to be detachably attached to an apparatus body and accommodate a developer inside, an attachment portion which is provided in the apparatus body and to which the developer accommodating container is attached, a first cover configured to be opened to an open state where an opening portion of the attachment portion is opened and closed to a closed state where the opening portion is closed, a first detection portion configured to detect an open state and a closed state of the first cover, a driving unit configured to bring the first cover from the closed state to the open state, an attachment detection unit configured to detect whether or not the developer accommodating container is attached to the attachment portion, and a control unit configured to control the driving unit to bring the first cover from the closed state to the open state in a case where the attachment detection unit detects an unattachment of the developer accommodating container to the attachment portion and the first detection portion detects that the first cover is in the closed state.

Further features of the present invention will become apparent from the following description of exemplary embodiments with reference to the attached drawings.

DESCRIPTION OF THE EMBODIMENTS

First Embodiment

Hereinafter, a first embodiment of the present disclosure will be described in detail with reference to FIGS. 1 to 8. To be noted, a tandem type full color printer is described as an example of an image forming apparatus in a first embodiment. However, this disclosure is not limited to the tandem type image forming apparatus, and the image forming apparatus of another system is acceptable. Further, this disclosure is not limited to the full color printer, and a monochrome or mono-color printer is acceptable.

General Configuration of Image Forming Apparatus

Figure 1:
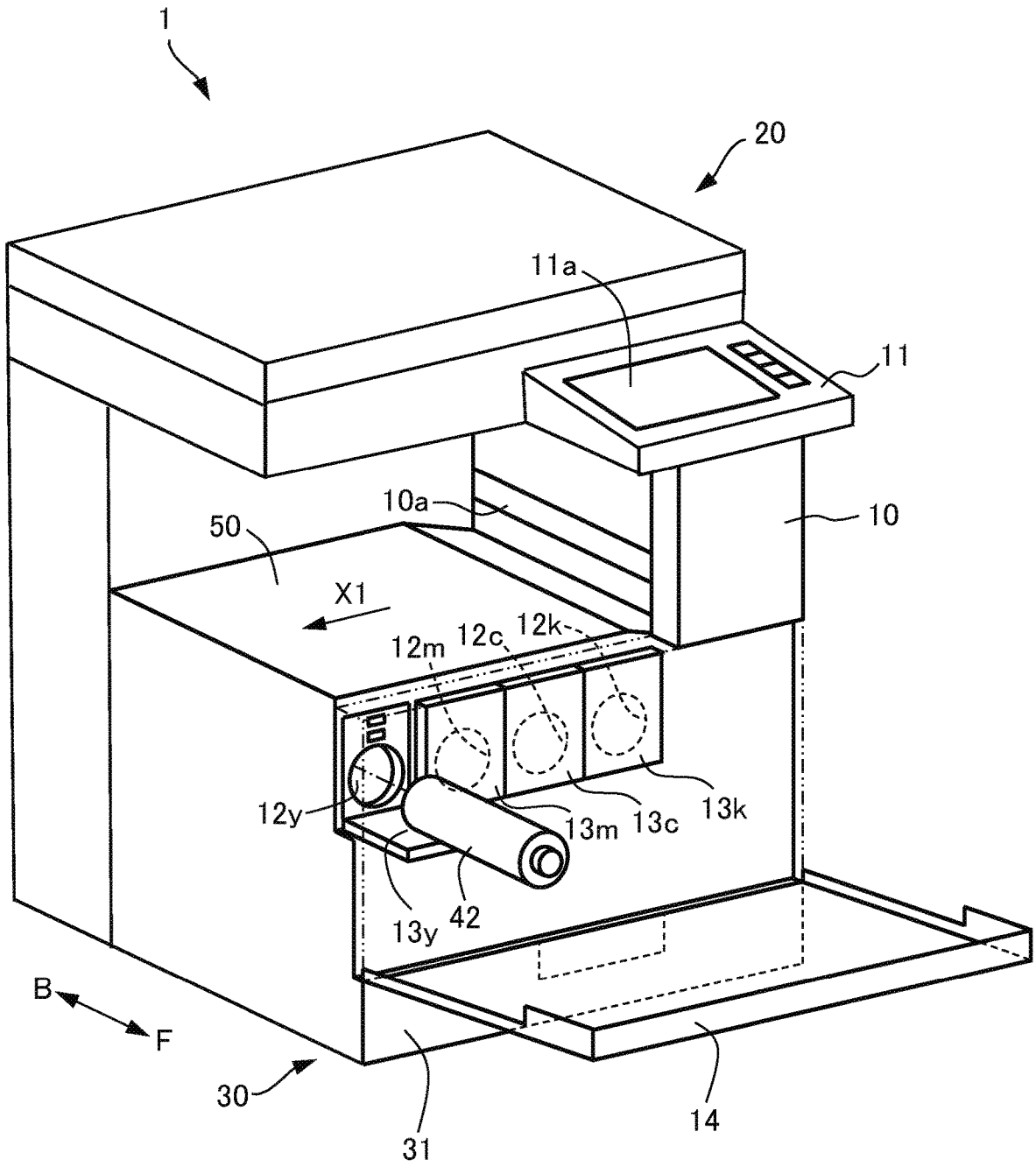
FIG. 1 is a perspective view showing a general configuration of an image forming apparatus according to a first embodiment.
Figure 2:
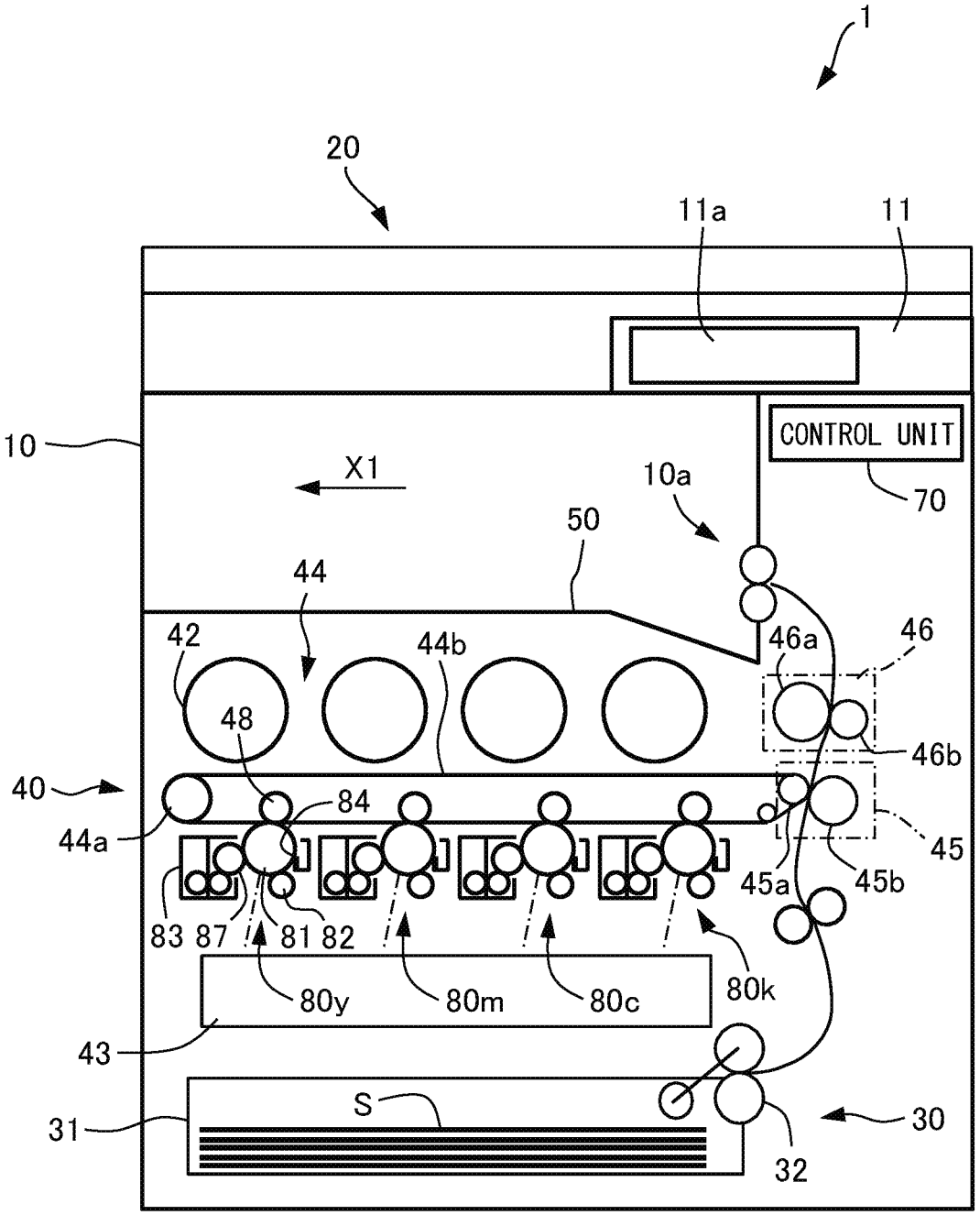
FIG. 2 is a cross-sectional view showing an outline of the image forming apparatus according to the first embodiment.

As shown in FIG. 2, the image forming apparatus 1 includes an apparatus body 10, an image reading unit 20, a sheet feeding unit 30, an image forming unit 40, and a control unit 70. As shown in FIGS. 1 and 2, an operation unit 11 is disposed at a front upper position of the apparatus body 10. Other than operation buttons, an operation panel, i.e., display unit 11*a*, which is capable to display a state of the image forming apparatus 1 and consists of a touch panel with a touch operation capability is disposed in the operation unit 11. The operation panel 11*a* is coupled to the control unit 70, and capable to output information from the control unit 70, and also capable to input information by the touch operation of a user to the control unit 70. To be noted, in this description, a front direction and back side direction of the image forming apparatus 1 are respectively referred to as a forward F and backward B.

As shown in FIG. 2, the image reading unit 20 is disposed in an upper part of the apparatus body 10. The image reading unit 20 includes a platen glass, not shown, as a document placing plate, a light source, not shown, to irradiate a light on a document placed on the platen glass, and an image sensor, not shown, to convert a reflected light into a digital signal. The sheet feeding unit 30 is disposed in a lower part of the apparatus body 10, and includes a sheet cassette 31 to pile and store a sheet S, and a feed roller 32. The sheet feeding unit 30 feeds the stored sheet S to the image forming unit 40 in a timing synchronizing with a toner image transferred onto an intermediate transfer belt 44*b*, described later. To be noted, the sheet S is a recording material on which the toner image is formed, and includes, for example, a standard paper, a sheet made of a resin which substitutes the standard paper, a cardboard, and a sheet for an overhead projector.

The image forming unit 40 includes image forming units 80*y*, 80*m*, 80*c*, and 80*k*, a laser scanner 43, an intermediate transfer unit 44, a secondary transfer unit 45, and a fixing unit 46. The image forming unit 40 is capable of forming an image on the sheet S based on an image information. The image forming apparatus 1 of the first embodiment corresponds to a full color printing. In this regard, the image forming units 80*y*, 80*m*, 80*c*, and 80*k* respectively correspond to 4 colors of yellow (y), magenta (m), cyan (c), and black (k), and are disposed independently from each other with a similar configuration. To be noted, the image forming units 80*y*, 80*m*, 80*c*, and 80*k* included in the image forming apparatus 1 are similar in a structure except for a difference in a color of a developer. Therefore, the image forming unit 80*y* will be described below as a representative, and descriptions of other image forming units are omitted herein.

In a case of the first embodiment, a toner container, i.e., developer accommodating container 42, is attached to the apparatus body 10 to store the developer which is supplied to a developing unit 83, described later, of the image forming unit 80*y*. The toner container 42 is, similar to the image forming units 80*y*, 80*m*, 80*c*, and 80*k*, provided for each of 4 colors of yellow (y), magenta (m), cyan (c), and black (k) with a same configuration, and disposed independently from each other. The toner container 42 is capable of storing the developer, and disposed above the image forming unit 80*y*. The toner container 42 is attached to an attachment portion 12*y* of a hole shape (refer to FIG. 1) disposed in the apparatus body 10 in an attachable and detachable manner. A plurality of the attachment portions 12*y*, 12*m*, 12*c*, and 12*k* are disposed corresponding to the toner containers of the different colors.

The toner container 42 is, for example, a cylindrical bottle with a toner discharge port at a first end, and having a spiral projection portion on an inner circumferential surface. By rotating the projection portion, the toner container 42 conveys the toner to the toner discharge port on the backward B. A supply mechanism, not shown, is disposed on the backward direction B of the attachment portion 12*y*, and an end of the toner container 42 on the backward B attached to the attachment portion 12*y* is coupled to the supply mechanism. A toner container drive motor 47 (refer to FIG. 3) is disposed in the supply mechanism, and the toner container drive motor 47 drivingly rotates the toner container 42 to convey the toner to the supply mechanism. That is, with respect to an insert direction to insert the toner container 42 into the attachment portion 12*y*, the drive motor 47 is disposed downstream of the attachment portion 12*y*. Then, a pump included in the supply mechanism is moved by rotation of the toner container 42, and discharges and supplies the toner conveyed to the supply mechanism to the developing unit 83. In the first embodiment, the toner which is obtained by kneading a binder resin mainly composed of polyester with a pigment and thereafter pulverized and classified is used, and has an average particle size of approximately 6 μm.

As shown in FIG. 1, in a forepart of the apparatus body 10, a plurality of small doors, i.e., first covers, 13*y*, 13*m*, 13*c*, and 13*k* are disposed in an openable and closable manner corresponding to the attachment portions 12*y*, 12*m*, 12*c*, and 12*k*, respectively. That is, with respect to the insert direction of the toner container 42, the small door 13*y* is disposed upstream of the attachment portion 12*y*. For example, when the small door 13*y* is opened, the toner container 42 is attachable to and detachable from the forepart of the apparatus body 10. Similarly, when the small doors 13*m*, 13*c*, and 13*k* are opened, the respective toner containers are attachable to and detachable from the forepart of the apparatus body 10. That is, the small door 13*y* is openable and closable so that the toner container 42 is capable of attaching to and detaching from the attachment portion 12*y* in an open state of the small door 13*y*, and the toner container 42 is not capable of attaching to and detaching from the attachment portion 12*y* in a closed state of the small door 13*y*. To be noted, a detailed configuration of the small door 13*y* will be described later.

In the forepart of the apparatus body 10, a front cover, i.e., second cover 14, which is capable of opening by pivoting to the forward F is disposed. The front cover 14 is openable and closable so that the front cover 14 exposes the small door 13*y* in the open state and covers the small door 13*y* in the closed state. That is, the front cover 14 in the open state exposes the small doors 13*y*, 13*m*, 13*c*, and 13*k* in the openable and closable manner, and in the closed state covers the small doors 13*y*, 13*m*, 13*c*, and 13*k*. Although, in the first embodiment, all the small doors 13*y*, 13*m*, 13*c*, and 13*k* are covered with one piece of the front cover 14, it is acceptable to include a plurality of the front covers (for example 2) and configure to cover one or plurality of the small door(s) with the respective plurality of the front covers. As shown in FIGS. 1 and 2, the front cover 14 is capable of exposing and covering, by an opening and closing thereof, the image forming units 80*y*, 80*m*, 80*c*, and 80*k* and the intermediate transfer unit 44, in addition to the small doors 13*y*, 13*m*, 13*c*, and 13*k*. Therefore, it is possible to perform a replacement or inspection of these units by opening the front cover 14. Further, a front cover opening/closing sensor, i.e., second detection portion, 15 which detects the opening and closing of the front cover 14 is disposed in the apparatus body 10 (refer to FIG. 4).

As shown in FIG. 2, the image forming unit 80*y* includes a photosensitive drum 81, a charge roller 82, the developing unit 83, and a cleaning unit 84. In the first embodiment, the image forming unit 80*y* is attachable to and detachable from the apparatus body 10. For example, the image forming unit 80*y* may be attachable to and detachable from the apparatus body 10 as a process cartridge including all of these units. On the other hand, it is also acceptable to configure the developing unit 83 attachable to and detachable from the apparatus body 10 as a developing cartridge, and configure a drum cartridge, in which the photosensitive drum 81, the charge roller 82, and the cleaning unit 84 are integrally included, attachable to and detachable from the apparatus body 10 independently from the developing cartridge.

The photosensitive drum 81 is rotated with a drum motor, not shown, and a surface of the photosensitive drum 81 is charged with the charge roller 82 at a time of the image formation. A laser beam is irradiated on a charged surface of the photosensitive drum 81 with the laser scanner 43 based on the image information, and an electrostatic latent image is born on the surface of the photosensitive drum 81. The developing unit 83 includes a developing sleeve 87 rotatably disposed in a developing container, and develops to visualize the electrostatic latent image born on the photosensitive drum 81 with the toner. In the developing unit 83, a two-component developer which is a mixture of a nonmagnetic toner and a magnetic carrier is stored, and the toner is supplied from the toner container 42 filled with the toner.

A toner concentration sensor, i.e., residual quantity detection unit 85, (refer to FIG. 3) is disposed in a part of a bottom of the developing unit 83. The toner concentration sensor 85, for example, consists of an inductance sensor, and is capable of detecting a toner concentration inside the developing unit 83, and sends a detection result to the control unit 70. The toner concentration sensor 85 is capable of detecting information regarding a residual quantity of the developer in the toner container 42. In this embodiment, the toner concentration sensor 85 is capable of detecting the residual quantity of the developer in the toner container 42. Also, the toner concentration sensor 85 corresponds to an output portion configured to output information of replacing the toner container 42. A method to detect the residual quantity of the developer in the toner container 42 with the toner concentration sensor 85 will be described later. In a case where the toner concentration detected with the toner concentration sensor 85 is lower than a target toner concentration, the control unit 70 drives the toner container drive motor 47 (refer to FIG. 3) and supplies the toner from the toner container 42 to the developing unit 83.

The intermediate transfer unit 44 is disposed above the image forming units 80*y*, 80*m*, 80*c*, and 80*k*. The intermediate transfer unit 44 includes a plurality of rollers, such as a drive roller 44*a*, a driven roller, not shown, and a primary transfer roller 48, and the intermediate transfer belt 44*b* which is wound around these rollers. The primary transfer roller 48 is disposed to face the photosensitive drum 81 and abuts on the intermediate transfer belt 44*b*.

The intermediate transfer belt 44*b* is provided with larger than a certain degree of a tensile force also at an idle time, and disposed in a contactable and separable manner with respect to the photosensitive drum 81. By applying a positive polarity transfer bias to the intermediate transfer belt 44*b*, respective negative polarity toner images on the photosensitive drums 81 are successively superimposed on the intermediate transfer belt 44*b* on each other. Thus, the intermediate transfer belt 44*b* is transferred and moved with the toner image of the full color which has been formed by developing the electrostatic latent image born on the surface of the photosensitive drum 81.

The secondary transfer unit 45 includes a secondary transfer internal roller 45*a* and a secondary transfer external roller 45*b*. By applying a secondary transfer bias of a positive polarity to the secondary transfer external roller 45*b*, a full color image formed on the intermediate transfer belt 44*b* is transferred to the sheet S. To be noted, the secondary transfer internal roller 45*a* stretches the intermediate transfer belt 44*b* from an inside thereof, and the secondary transfer external roller 45*b* is disposed to face the secondary transfer internal roller 45*a* across the intermediate transfer belt 44*b*.

The fixing unit 46 includes a fixing roller 46*a* and a press roller 46*b*. By conveying the sheet S between the fixing roller 46*a* and the press roller 46*b* in a sandwiched manner, the toner image transferred to the sheet S is heated and pressed, and fixed to the sheet S. The sheet S fed from the sheet feeding unit 30 is passed through the secondary transfer unit 45 and the fixing unit 46, and conveyed to a sheet discharge tray 50. The sheet discharge tray 50 is a facedown tray, and stacks the sheet S discharged in an arrow X1 direction from a sheet discharge port 10*a*.

Figure 3:
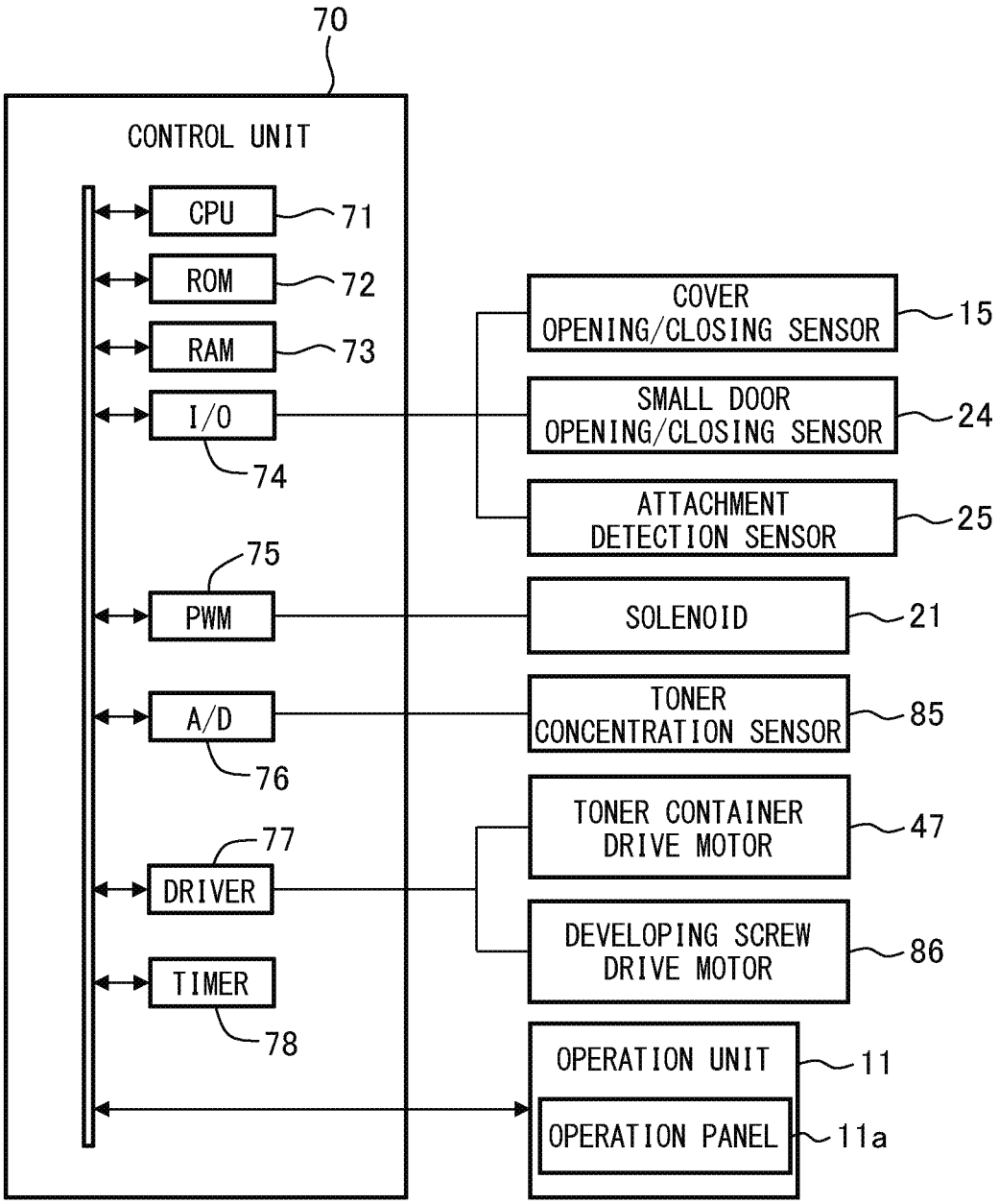
FIG. 3 is a block diagram showing a control system of the image forming apparatus according to the first embodiment.

As shown in FIG. 3, the control unit 70 includes a central processing unit (CPU) 71, a read only memory (ROM) 72 which stores a program to control each unit, a random access memory (RAM) 73 which temporarily stores data, and an input/output circuit (I/O) 74 to input/output a signal from and to outside. Further, the control unit 70 includes a pulse width modulation (PWM) unit 75, an A/D conversion unit (A/D) 76, a motor driving unit, i.e., driver, 77 to perform a motor drive control, and a timer 78 to generate a control timing. The I/O 74 is coupled to the cover opening/closing sensor 15 of each color, a small door opening/closing sensor, i.e., first detection portion, 24, and an attachment detection sensor, i.e., attachment detection unit, 25. The PWM unit 75 is coupled to a solenoid 21 of each color, and is capable of performing control to disengage a lock of the small door 13*y* (refer to FIG. 1) in the closed state. The A/D 76 converts an analog signal of the detection result from the toner concentration sensor 85 of each color to a digital signal. The motor driving unit 77 is coupled to the toner container drive motor 47 of each color and a developing screw drive motor 86 of each color. Further, the control unit 70 is coupled to an upper rank computer, not shown. The control unit 70 is capable of operating the operation unit 11, and based on an instruction from the upper rank computer, not shown, capable of performing a setting change of a printer, and starting an image forming job.

When the image forming job is submitted, the CPU 71 drives the developing screw drive motor 86 of each color. Based on information such as the detection result of the toner concentration sensor 85 of each color, the CPU 71 drives the toner container drive motor 47 and supplies the toner to the developing unit 83. For example, in a case where a threshold value for a number of times of toner absence is an X time, the control unit 70 judges that the toner in the toner container 42 is absent when the detection result of the toner concentration sensor 85 is smaller than a lower concentration limit y after drivingly rotated the toner container drive motor 47 the X times. Thus, in a case where, based on the detection result of the toner concentration sensor 85 and the number of times which the toner container drive motor 47 has driven, the control unit 70 judges that the toner is absent in the toner container 42, the control unit 70, for example, displays a message urging to replace the toner container 42 on the operation panel 11*a*. Alternatively, the control unit 70 outputs information to an external computer coupled to the image forming apparatus 1, and displays the message urging to replace the toner container 42 on a monitor of the computer. That is, based on the detection result of the toner concentration sensor 85, the control unit 70 urges a user to replace the toner container 42. In this case, in a case where the control unit 70 detects the opening of the front cover 14 with the cover opening/closing sensor 15, the control unit 70 opens the small door 13*y* with an opening mechanism 27 (refer to FIG. 4), described later.

Further, in a case where the attachment detection sensor 25 is an OFF state, the control unit 70 judges that the toner container 42 is not attached. That is, the attachment detection sensor 25 is capable of detecting an attachment and unattachment of the toner container 42 to and from the attachment portion 12*y* (refer to FIG. 1). In the first embodiment, in a case where the control unit 70 judges that the toner in any one of the toner containers of yellow, magenta, cyan, and black is absent, the control unit 70 moves a mode to a color degeneration mode which allows only a monochrome image formation. On the other hand, in a case where the toner in the toner container 42 for black is judged to be absent, the mode is moved to a toner absent mode where the image formation is not allowed.

Small Door and Front Cover

Figure 4:
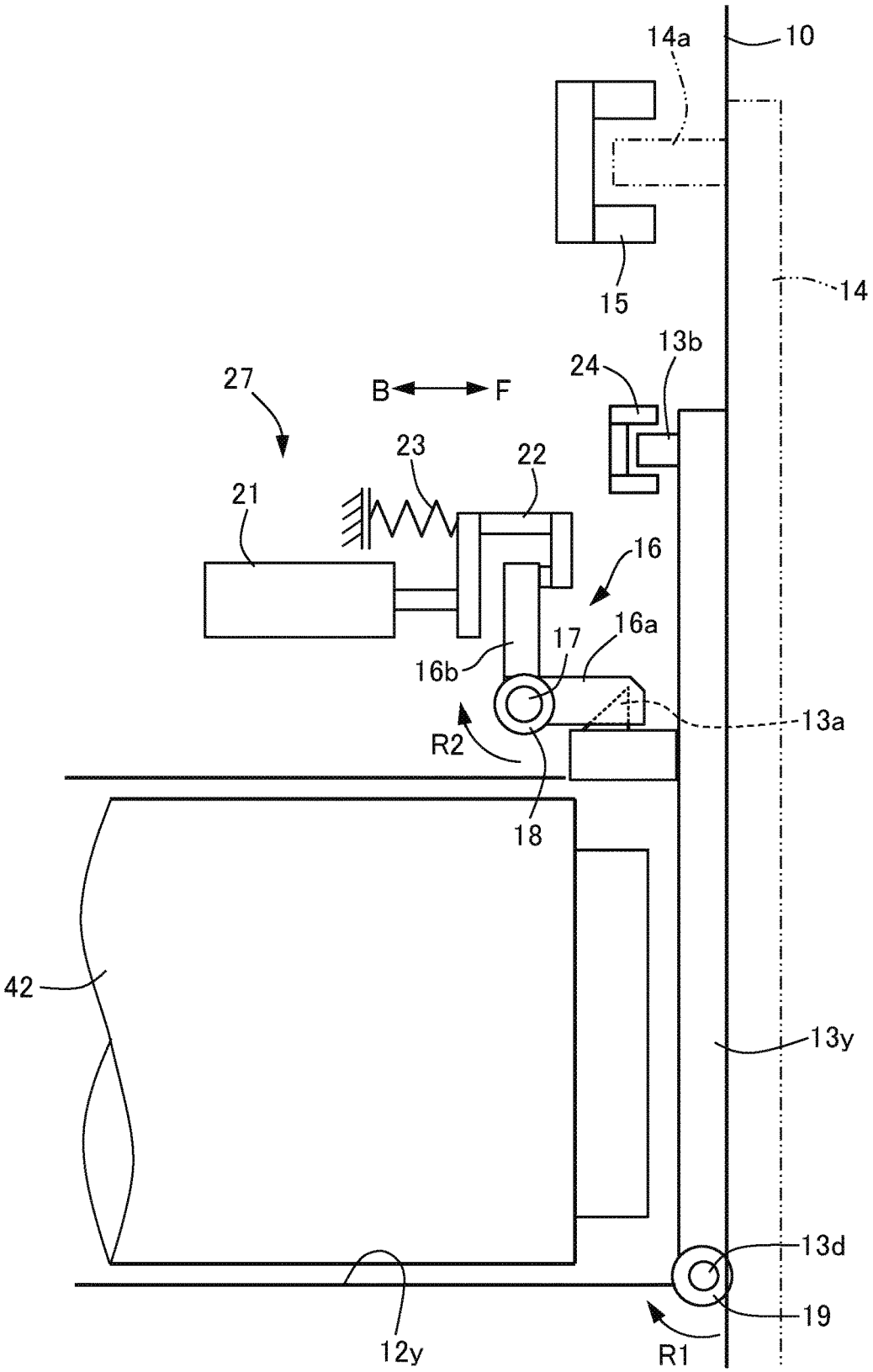
FIG. 4 is a side view of the image forming apparatus according to the first embodiment showing a small door in a closed state.

Next, a configuration of the small door 13*y* and the front cover 14 will be described in detail using FIGS. 4 to 7. As shown in FIG. 4, in a case where the front cover 14 is in the closed state (an imaginary line, i.e., two-dot chain line, in FIG. 4), a shield portion 14*a* disposed at an upper part of the front cover 14 is detected with the cover opening/closing sensor 15. The cover opening/closing sensor 15, for example, consists of a transmissive photosensor having a light emitting component and a photo sensing portion, and is capable of detecting whether or not the front cover 14 is in the closed state based on whether or not the light from the light emitting component to the photo sensing portion is blocked with the shield portion 14*a* of the front cover 14.

The small door 13*y* regulates the attachment and detachment of the toner container 42 to and from the attachment portion 12*y* by displacing to the closed state. Inside the small door 13*y*, a claw portion 13*a*, which protrudes upward, and a shield portion 13*b* are disposed. In the closed state of the small door 13*y*, the claw portion 13*a* is formed such that a surface on the forward F is upright and a surface on the backward B is inclined. The small door 13*y* is pivotable around a shaft member 13*d* disposed at a lower position as a center, and always urged in an R1 rotation direction, that is, an opening direction with an urging spring, i.e., urging portion, 19 consisting of a torsion coil spring.

As shown in FIG. 4, when the small door 13*y* is in the open state, the shield portion 13*b* of the small door 13*y* is detected with the small door opening/closing sensor 24. The small door opening/closing sensor 24, for example, consists of the transmissive photosensor having the light emitting component and the photo sensing portion, and is capable of detecting the opening and closing of the small door 13*y* based on whether or not the light from the light emitting component to the photo sensing portion is blocked with the shield portion 13*b* of the small door 13*y*.

Inside the apparatus body 10, a latch, i.e., locking unit 16, is disposed in adjacencies of the claw portion 13*a* of the small door 13*y* in the closed state shown in FIG. 4. The latch 16 includes a lock portion 16*a* which is capable of engaging with the claw portion 13*a* of the small door 13*y* in the closed state, an engagement portion 16*b* which is pivotable with the lock portion 16*a* and engages with a link 22 coupled to the solenoid 21. The latch 16 is disposed rotatably around a shaft member 17 disposed in the apparatus body 10 as a center. The latch 16 is always urged in an R2 rotation direction, i.e., a direction in which the lock portion 16*a* is engaged with the claw portion 13*a*, with an urging spring 18 consisting of a return coil spring. Herewith, the latch 16 is capable to lock the small door 13*y* in the closed state. That is, the small door 13*y* is lockable in the closed state. In the apparatus body 10, the solenoid 21, as an example of the driving unit, and the link 22 coupled to the aforementioned solenoid 21 are disposed. The link 22 is movable in a front-back direction, and urged to the forward F with a return spring 23 consisting of a compression coil spring. Further, the link 22 is disposed such that the link 22 is capable of engaging with a front portion of the engagement portion 16*b* of the latch 16.

In the case of the first embodiment, when the small door 13*y* is in the closed state, the solenoid 21 is in the OFF state (a non-energized state), and the link 22 is positioned on a front side by being pressed to the forward F direction with the return spring 23. At this time, the latch 16 is urged with the urging spring 18 in the R2 rotation direction, and the lock portion 16*a* engages with the claw portion 13*a* so that the small door 13*y* does not rotate to open in the R1 rotation direction by being urged with an urging spring 19 and is locked in the closed state. To be noted, by engaging the upright surface in the front side of the claw portion 13*a* with the lock portion 16*a*, an unexpected opening of the small door 13*y* with an urging force of the urging spring 19 is prevented.

Figure 6:
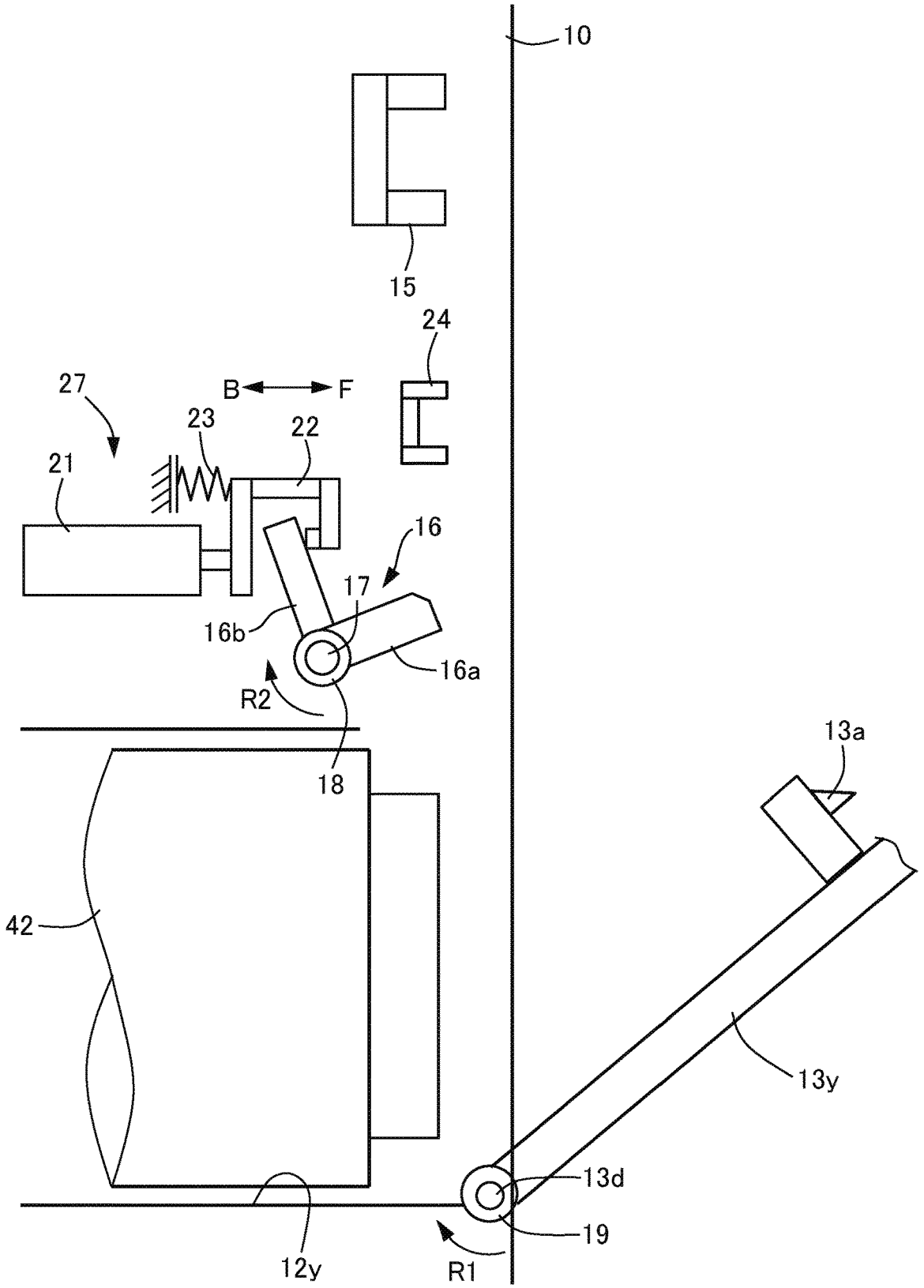
FIG. 6 is the side view of the image forming apparatus according to the first embodiment showing the small door in an open state.

As shown in FIG. 6, in a case where the solenoid 21 is in an ON state (an energized state), the link 22 moves to the backward B against an urging force of the return spring 23. Then, a force to pivot the engagement portion 16*b* which engages with the link 22 is provided, the latch 16 pivots in an opposite direction of the R2 rotation direction against an urging force of the urging spring 18. Thus, the lock portion 16*a* is disengaged from the claw portion 13*a*, and the small door 13*y* is automatically opened in the R1 rotation direction with the urging spring 19 (brought to the open state). That is, the control unit 70 performs an opening movement of the small door 13*y* by turning the solenoid 21 to the ON state and disengaging the lock with the latch 16.

In the first embodiment, the solenoid 21, the urging spring 19, and the latch 16 form the opening mechanism, i.e., opening unit, 27. That is, the opening mechanism 27 is capable of automatically opening the small door 13*y* from the closed state to the open state, and, to open the small door 13*y*, the control unit 70 disengage the lock of the small door 13*y* in the closed state with the latch 16.

To be noted, in the first embodiment, a rod coupled to the link 22 is moved to the backward B by energizing the solenoid 21, and, by non-energizing the solenoid 21, is moved in an opposite direction to return to an original position by the urging force of the return spring 23. However, depending on a form of an engagement of the link 22 and the lock portion 16*a*, it is acceptable to configure the movement such that the rod is moved to the forward F by energizing the solenoid 21 and returned with the return spring when the solenoid 21 is non-energized. Further, in the first embodiment, the urging spring is used to obtain the urging force to open the small door 13*y*, it is not limited to this. For example, it is acceptable to use a motor or a solenoid, or, by positioning a gravity center of the small door 13*y* at an opposite side of the attachment portion 12*y* with respect to a swing center line of the small door 13*y*, acceptable to configure to open the small door 13*y* under an own weight thereof.

As described above, after the small door 13*y* has been brought to the open state by turning the solenoid 21 to the OFF state, in a case where the user moves the small door 13*y* in the open state in an opposite direction of the R1 rotation direction, the small door 13*y* is closed. At this time, along with a pivot of the small door 13*y*, the claw portion 13*a* of the small door 13*y* pushes up the lock portion 16*a* of the latch 16 so that the lock portion 16*a* pivots against the urging force of the urging spring 18. At this point, by engaging an inclined rear surface of the claw portion 13*a* with the lock portion 16*a*, it is possible to easily push up the lock portion 16*a* against the urging force of the urging spring 18, and engage the claw portion 13*a* with the lock portion 16*a*. When the claw portion 13*a* is pushed into a position where the claw portion 13*a* is engaged with the lock portion 16*a*, the lock portion 16*a* is engaged with the claw portion 13*a* with the urging spring 18 at a position shown in FIG. 4. To be noted, configurations to open and close the small door 13*y* and to lock in the closed state are not limited to the configurations described above, needless to say, it is acceptable to apply other configurations which were hitherto known.

Figure 5:
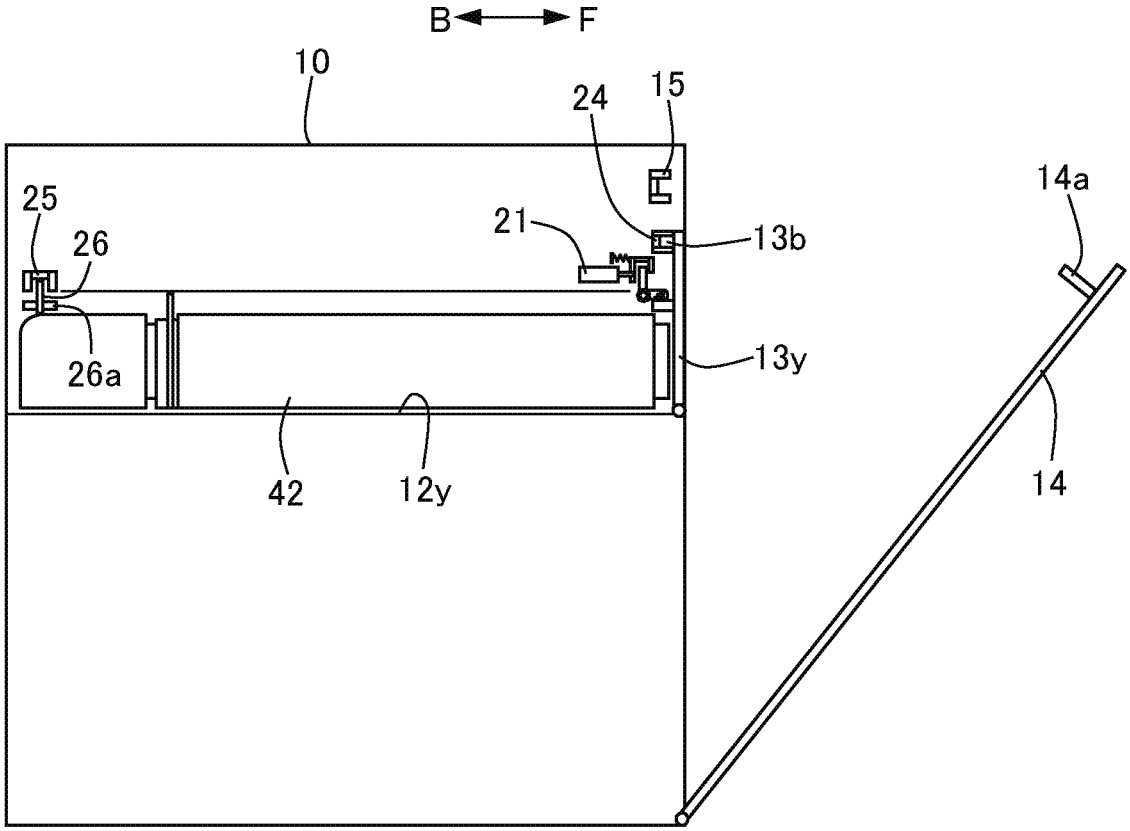
FIG. 5 is the side view of the image forming apparatus according to the first embodiment showing the small door in the closed state, a front cover, and a toner container.
Figure 7:
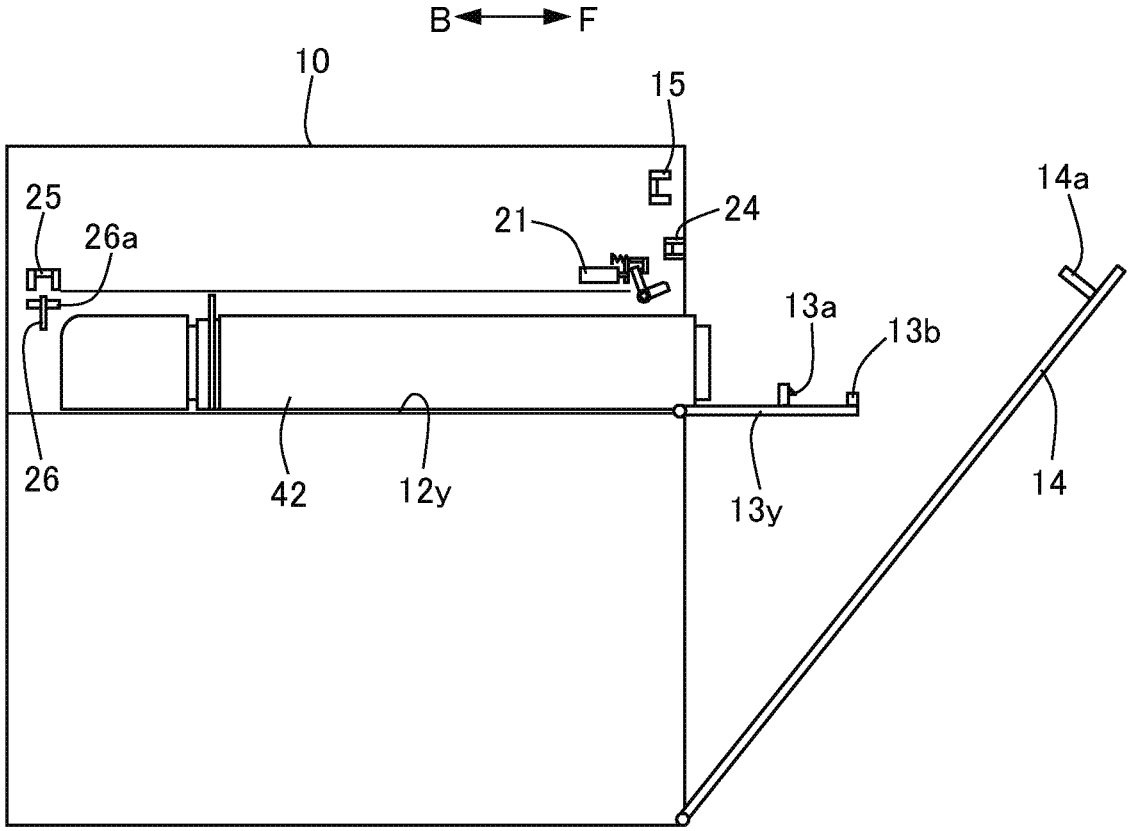
FIG. 7 is the side view of the image forming apparatus according to the first embodiment showing the small door in the open state, the front cover, and the toner container.

As shown in FIGS. 5 and 7, on the backward B of the attachment portion 12*y*, the attachment detection sensor 25 and an attachment detection flag 26 are disposed. The attachment detection sensor 25, for example, consists of the transmissive photosensor having the light emitting component and the photo sensing portion. The attachment detection flag 26 is disposed rotatably around a shaft member 26*a*, which is a rotation shaft extending in the front-back direction, as a center, and capable of moving rotationally between a position to block the attachment detection sensor 25, as shown in FIG. 5, and a position not to block the attachment detection sensor 25, as shown in FIG. 7. As shown in FIG. 5, when the toner container 42 is attached, the edge of the toner container 42 on the backward B pushes up the attachment detection flag 26 by abutting thereon, and the attachment detection flag 26 is detected with the attachment detection sensor 25. On the other hand, as shown in FIG. 7, when the toner container 42 is moved from an attaching position to a detached position, the attachment detection flag 26 is released from the edge of the toner container 42 on the backward B and rotationally moved downward under the own weight thereof, and becomes not detected with the attachment detection sensor 25. Therefore, the attachment detection sensor 25 is capable of detecting whether the toner container 42 is in an attached state or not in the attached state, that is, in an unattached state based on a detection result of whether or not the light from the light emitting component to the photo sensing portion is blocked with the attachment detection flag 26.

Figure 8:
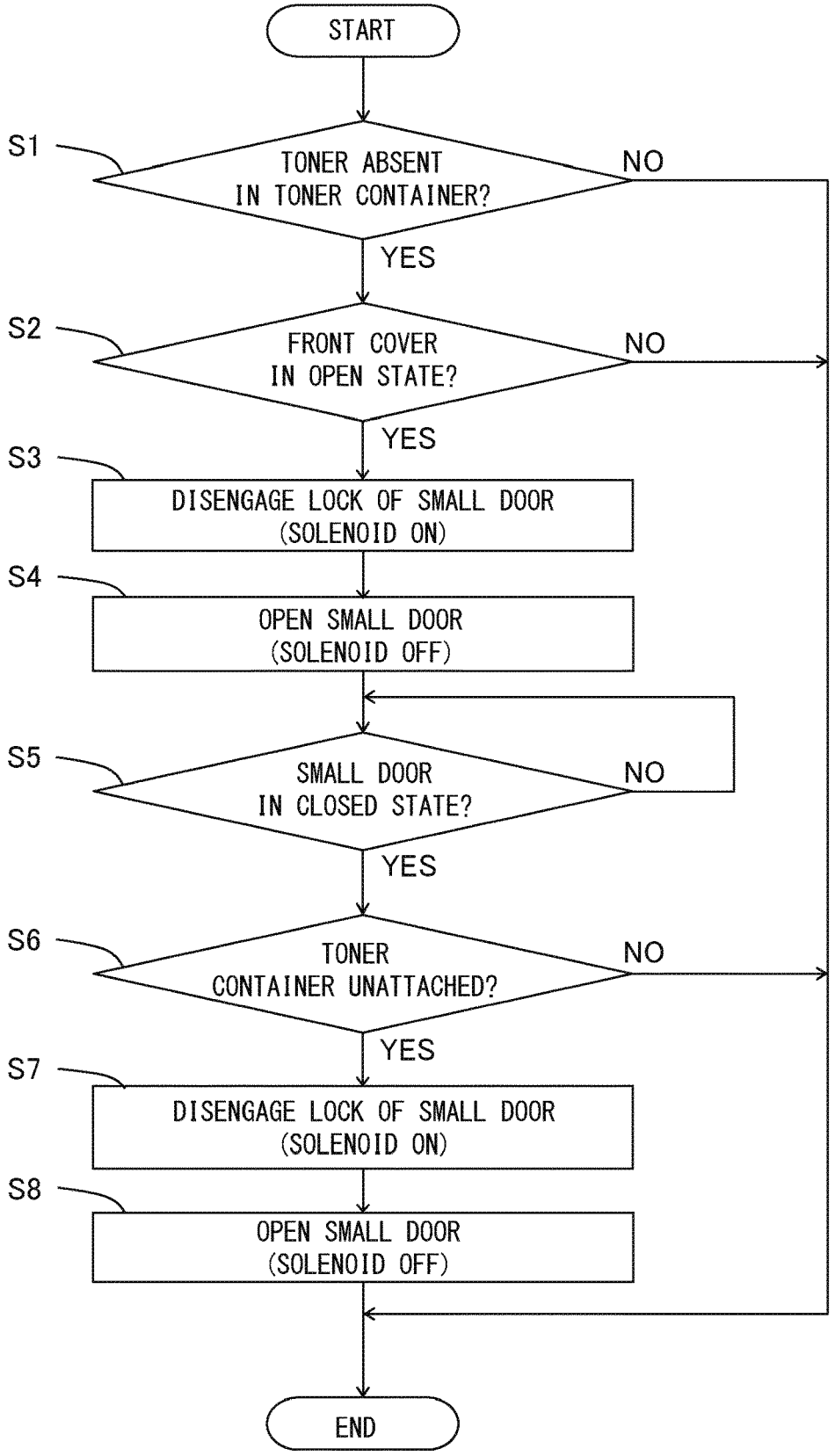
FIG. 8 is a flowchart showing processing of a toner container replacement in the image forming apparatus according to the first embodiment.

Next, in the image forming apparatus 1 described above, a processing sequence which is performed when the front cover 14 is opened will be described along a flowchart shown in FIG. 8. The CPU 71 judges whether or not the toner is absent in the toner container 42 of each color (step S1). At this step, in a case where the detection result of the toner concentration sensor 85 does not exceed the lower limit of the concentration Y after having rotatably driven the toner container drive motor 47 the X times continually, the CPU 71 judges that the toner in the toner container 42 of the color is absent. The CPU 71 ends processing in a case where the toner container 42 is judged to be not absent of the toner (NO at step S1).

In a case where the toner container 42 of any color is judged to be absent of the toner (YES at step S1), the CPU 71 starts the processing to replace the toner container 42 of the color. The CPU 71 judges with the cover opening/closing sensor 15 whether or not the front cover 14 is in the open state (step S2). In a case where the front cover 14 is judged to be not in the open state (NO at step S2), the CPU 71 ends the processing. In a case where the front cover 14 is judged to be in the open state (YES at step S2), the CPU 71 turns on the solenoid 21 of the toner container 42 of a target for replacement corresponding to the color and disengages the lock in the closed state of the small door 13*y* corresponding to the color (step S3). Thus, by disengaging the lock in the closed state of the small door 13*y* with the latch 16, the small door 13*y* is opened with the urging spring 19 (step S4). That is, based on the detection result of the toner concentration sensor 85, the CPU 71 opens the small door 13*y* to replace the toner container 42 attached to the attachment portion 12*y* when the front cover 14 is in the open state. In the first embodiment, only the small door 13*y* of the attachment portion 12*y* to which the toner container 42 of the target for the replacement is attached is opened.

When the CPU 71 detects with the small door opening/closing sensor 24 that the small door 13*y* is in the open state, the CPU 71 turns off the solenoid 21 of the toner container 42 corresponding to the color. Thus, it is possible to reduce unnecessary electricity. Since, at this time, both of the front cover 14 and the small door 13*y* which correspond to the toner container 42 requiring the replacement are in the open state, the user is able to detach the toner container 42 and attach the new toner container.

The CPU 71 judges with the small door opening/closing sensor 24 whether or not the small door 13*y* is brought from the open state to the closed state (step S5). In a case where the small door 13*y* is judged to be not in the closed state (NO at step S6), the CPU 71 performs a judgement again (step S5). In a case where the small door 13*y* is judged to be in the closed state (YES at step S5), the CPU 71 judges with the attachment detection sensor 25 whether or not the toner container 42 of the color is unattached (step S6). In a case where the toner container 42 of the color is judged to be not unattached, that is, attached (NO at step S6), the CPU 71 ends the processing.

On the other hand, in a case where the toner container 42 is judged to be unattached (YES at step S6), the CPU 71 turns on the solenoid 21 and disengages the lock in the closed state of the small door 13*y* corresponding to the color (step S7). That is, in a case where the toner container 42 is detected to be unattached to the attachment portion 12*y* with the attachment detection sensor 25, the CPU 71 opens the small door 13*y* with the opening mechanism 27 when the closed state of the small door 13*y* is detected with the small door opening/closing sensor 24 after the small door 13*y* has been opened. As described above, when the solenoid 21 of the opening mechanism 27 is turned on to disengage the lock in the closed state of the small door 13*y* with the latch 16, the small door 13*y* is brought to the open state with the urging spring 19 (step S8). Further, in a case where the small door 13*y* is detected to be in the open state with the small door opening/closing sensor 24, the CPU 71 turns the solenoid 21 into the OFF state. Herewith, it is possible to reduce the unnecessary electricity. Thus, in a case where the toner container is unattached, by automatically reopening the small door 13*y* when the small door 13*y* is closed, it is possible for the user to recognize that the toner container 42 is unattached.

Further, in a case where the small door 13*y* is closed with the toner container 42 unattached to the attachment portion 12*y*, it is acceptable to configure the CPU 71 such that the operation panel 11*a* as the display unit displays the message informing an unattachment of the toner container 42 to the attachment portion 12*y*. Alternatively, it is acceptable to emit a warning sound from a built-in speaker of the image forming apparatus.

As described above, in the image forming apparatus 1 of the first embodiment, in a case where the toner container 42 is detected to be unattached to the attachment portion 12*y* with the attachment detection sensor 25, the control unit 70 performs the processing as described below. That is, in a case where the small door opening/closing sensor 24 detects the closed state of the small door 13*y* with the toner container 42 unattached, the control unit 70 brings the small door 13*y* to the open state with the opening mechanism 27. Herewith, in a case where, at the replacement of the toner container 42, the user has closed the small door 13*y* without noticing the unattachment of the toner container 42, the small door 13*y* is automatically opened, and the user is able to recognize the unattachment of the toner container 42 before closing the front cover 14. In other words, in a case where the user has closed the small door 13*y* of the attachment portion 12*y* without attaching the toner container 42, it is possible to prevent a troublesome work, such as, to open the front cover 14 again. That is, when the toner container 42 is unattached, it is possible to improve an operability.

Further, in the image forming apparatus 1 of the first embodiment, in a case where the replacement of the toner container 42 has become necessary, such as a case where a residual quantity of the developer in the toner container 42 attached to the attachment portion 12*y* has been lessened to less than a predetermined quantity, the control unit 70 is capable of automatically opening the small door 13*y* with the opening mechanism 27. Thus, it is possible to facilitate a replacement work of the toner container 42 to be carried out by the user. To be noted, in the first embodiment, the small door 13*y* of the target is opened in a case where the front cover 14 is detected to be in the open state. However, for example, it is acceptable to configure the processing such that, by disengaging the lock of the small door 13*y* of the target in advance even if the front cover 14 has been closed, the small door 13*y* with the lock already disengaged is opened when the front cover 14 is opened.

To be noted, although, in the image forming apparatus 1 of the first embodiment, the solenoid 21 is configured to return with the return spring when the electricity is turned off, a configuration of the solenoid is not limited to this. For example, it is acceptable to use a self-holding type solenoid, which does not return to an original position when the electricity is turned off and maintains a position displaced when the electricity was turned on, for the solenoid 21. Herewith, for example, in a case where the electricity is turned off while the lock of the small door 13*y* is being disengaged, disengagement of the lock is maintained. In this case, when the small door 13*y* is closed by the user with the lock of the small door 13*y* disengaged, and the closed state of the small door 13*y* is detected with the small door opening/closing sensor 24, the control unit 70 refers to the attachment detection sensor 25. In a case where the attachment detection sensor 25 detects the unattachment of the toner container 42, the control unit 70 does not turn on the electricity to the solenoid 21, and holds the lock of the small door 13*y* in a disengaging state. Further, in a case where the attachment detection sensor 25 detects an attachment of the toner container 42, the control unit 70 turns on the electricity to the solenoid 21, and lock the small door 13*y* in the closed state.

Further, although, in the image forming apparatus 1 of the first embodiment, the residual quantity of the toner in the toner container 42 is detected based on the detection result of the toner concentration sensor 85, it is not limited to this. For example, it is acceptable to provide a storage container at a toner hopper to store the toner discharged from the toner container 42, and dispose a residual quantity detection sensor, i.e., the residual quantity detection unit, on a wall of the storage container. This residual quantity detection sensor is, for example, a piezo type sensor, capable of detecting information regarding the residual quantity of the developer in the toner container 42 by detecting a height of a toner powder using a change in an output voltage due to presence and absence of the toner in adjacencies of a sensor surface.

Second Embodiment

Next, a second embodiment of the present disclosure will be described in detail with reference to FIGS. 9 to 22. An electric drive motor is used as a mechanism to open a small door, and the second embodiment is different from the first embodiment at this point.

General Configuration of Image Forming Apparatus

Figure 9:
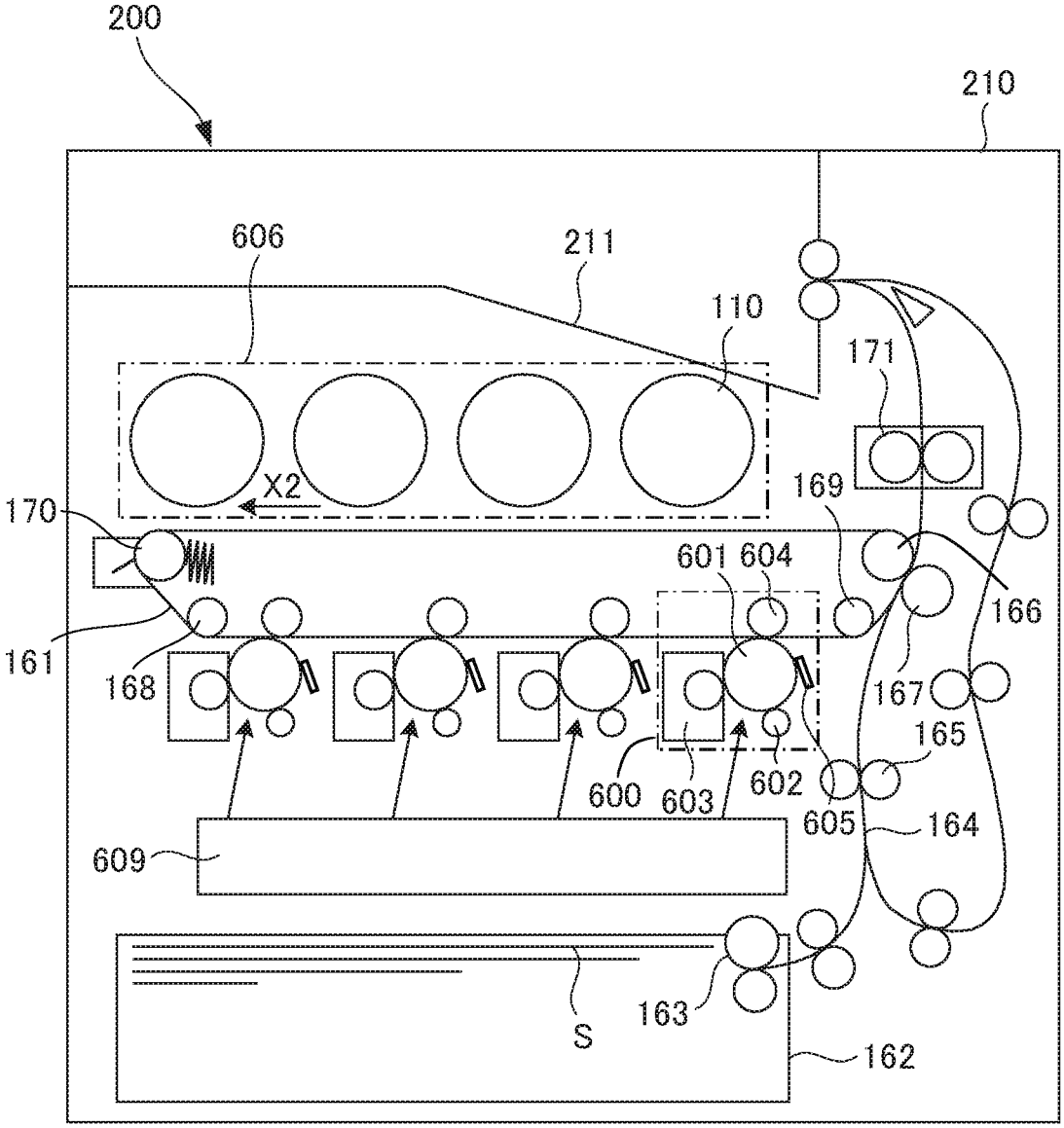
FIG. 9 is a cross-sectional view of an image forming apparatus according to a second embodiment.

FIG. 9 is a cross-sectional view of an image forming apparatus 200 which is an example of the second embodiment of the present disclosure. The second embodiment is a color image forming unit using an electrophotographic system, and recently an intermediate transfer tandem type, in which image forming units of 4 colors are arranged on an intermediate transfer belt, becomes a mainstream because of advantages in adaptability to various sheet materials and good printing productivity. In the second embodiment, an image is formed with 4 colors of yellow (Y), cyan (C), magenta (M), and black (B). Needless to say, a number of the colors are not limited to 4, and a sequence of the colors is not limited to this. An image forming process to form an image on a sheet with the image forming apparatus which is an example of the second embodiment will be described below.

A sheet S is stored in a sheet storage portion 162 in a stacked form, and fed with a sheet feeding unit 163 in a timing synchronizing with an image formation. The sheet S sent out with the sheet feeding unit 163 passes through a sheet conveyance path 164, and is conveyed to a registration roller 165. At the registration roller 165, having corrected a sheet skew of the sheet S conveyed from the sheet storage portion 162, the sheet S is conveyed to a secondary transfer portion in a predetermined timing synchronizing with a toner image formed on an intermediate transfer belt 161. The secondary transfer portion is a toner image transfer nip portion to transfer a toner image onto the sheet S, and formed with a secondary transfer internal roller 166 and a secondary transfer external roller 167 facing each other. The secondary transfer portion transfers the toner image formed on the intermediate transfer belt 161 onto the sheet S by providing a predetermined pressure and an electrostatic load bias. The image forming process to form the toner image on the intermediate transfer belt 161 will be described next.

An image forming unit 600 is principally configured with such as a photosensitive member 601, a charge roller 602 as a charge member, a developing unit 603, a primary transfer roller 604 as a primary transfer member, and a photosensitive member cleaner 605. Further, a similar configuration is applied to the 4 colors of yellow (Y), cyan (C), magenta (M), and black (B), and the image forming unit 600 of each color is arranged in parallel with each other. To be noted, the image forming units 600 are similar in a structure except for a difference in the color of a developer. Therefore, the image forming unit 600 for black will be described below as a representative, and descriptions of other image forming units are omitted herein. A toner supply apparatus 606 is disposed above the image forming unit 600, and a toner container 110 is provided as a developer accommodating container corresponding to each color of the image forming units. The toner supply apparatus 606 will be described later in detail.

Regarding the image forming process, first, an electrostatic latent image is born on a surface of the photosensitive member 601 based on a signal of image information sent from an exposing unit 609. To be noted, the surface of the photosensitive member 601 has been uniformly charged with the charge roller 602 in advance. Then, the electrostatic latent image born on the photosensitive member 601 is developed with the toner in the developing unit 603, and visualized as the toner image on the photosensitive member 601. Thereafter, by providing a predetermined pressure and an electrostatic load bias with the primary transfer roller 604, the toner image is transferred onto the intermediate transfer belt 161. A transfer residual toner barely remained on the photosensitive member 601 is recovered with the photosensitive member cleaner 605. Further, the toner consumed with the developing unit 603 is supplied from a toner container 110, and the image forming apparatus 200 is prepared for a next image formation again. The intermediate transfer belt 161 is stretched with rollers, such as driven rollers 168, 169, a tension roller 170, and the secondary transfer internal roller 166, drivingly conveyed in an arrow X2 direction in FIG. 9. The image forming process with each of the image forming units of colors Y, M, C, and K described above is performed in parallel with each other in a timing to superimpose the toner image on the toner image of an upstream color on the intermediate transfer belt 161. Therefore, the toner image of a full color is eventually formed on the intermediate transfer belt 161, and conveyed to the secondary transfer portion.

Along the process described above, the full color toner image is secondarily transferred to the sheet S at the secondary transfer portion. Thereafter, the sheet S is conveyed to a fixing unit 171. The fixing unit 171 fixes the toner image on the sheet S with a predetermined pressure force with such as rollers or belts facing each other and adding a heat with a heat source such as, generally, a heater and fusion bonding the toner image. The sheet S given a fixing process in the fixing unit 171 is discharged to a sheet discharge tray 211, and an image forming operation is completed.

Toner Supply Apparatus

Figure 10A:
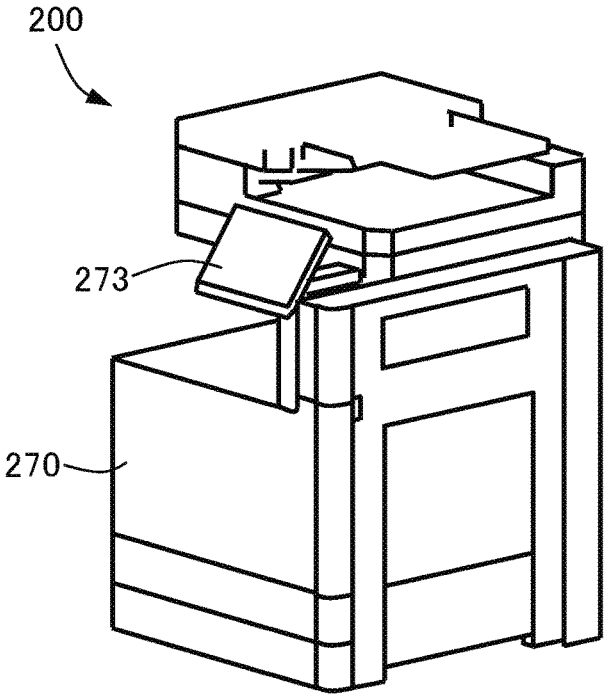
FIG. 10A is a schematic perspective view of the image forming apparatus according to the second embodiment with a front cover closed.
Figure 10B:
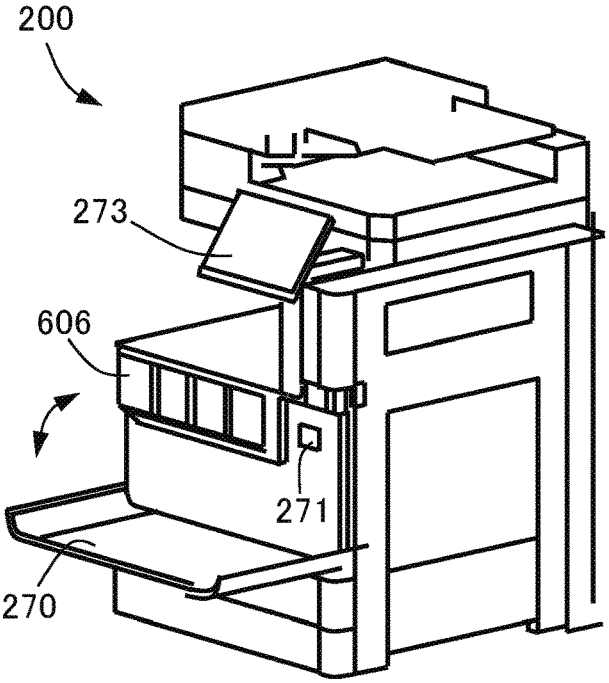
FIG. 10B is the schematic perspective view of the image forming apparatus according to the second embodiment with the front cover opened.
Figure 11A:
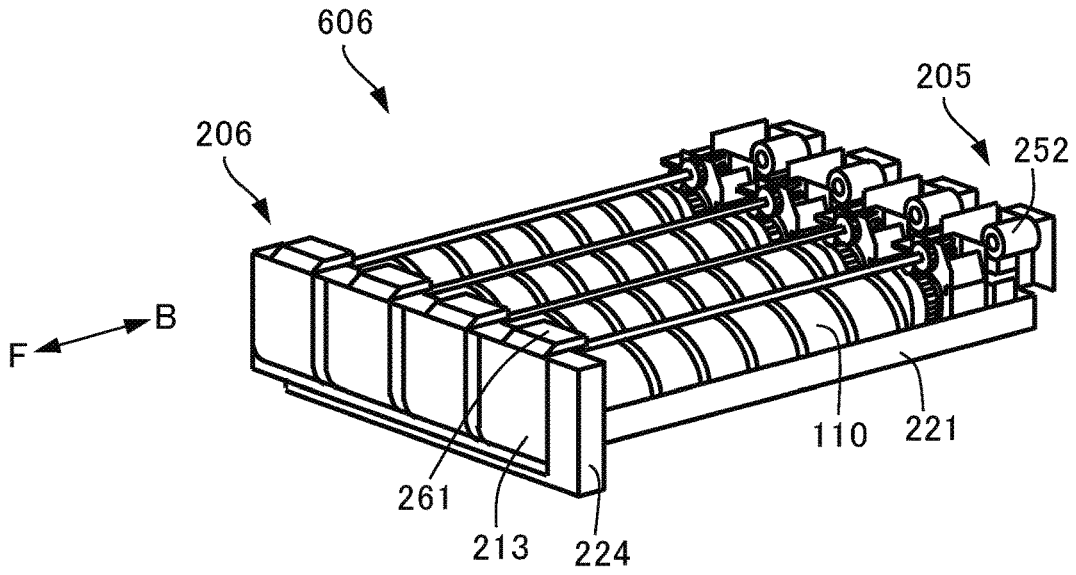
FIG. 11A is a perspective view of a toner supply unit according to the second embodiment with a small door closed after attaching all toner containers.
Figure 11B:
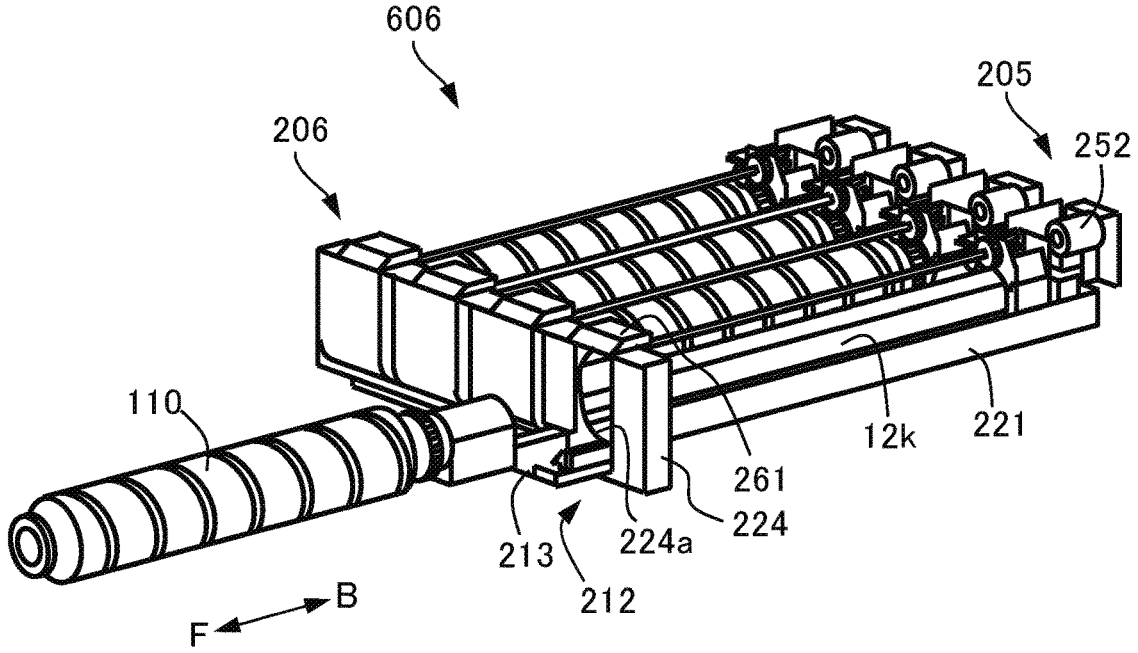
FIG. 11B is a perspective view of the toner supply unit according to the second embodiment with the toner container being detached by opening a part of the small doors.

FIGS. 10A and 10B show an external view of the image forming apparatus 200, and FIGS. 11A and 11B show a perspective view of the toner supply apparatus 606. As shown in FIGS. 10A and 10B, on a front side of the image forming apparatus 200, a front cover 270 which is openable and closable with hands is disposed, and by opening the front cover 270 the toner supply apparatus 606 is accessible (refer to FIG. 10B). The front cover 270 is an example of a second cover. To be noted, the toner supply apparatus 606 is provided with a same structure for each of 4 colors of yellow (Y), magenta (M), cyan (C), and black (K), and disposed in parallel with each other, and the toner supply apparatus 606 of each color has a same structure except for a difference in a developing color. That is, each constituent of the toner supply apparatus 606 is disposed plurally in accordance with the developing colors.

As shown in FIGS. 11A and 11B, for example, the toner supply apparatus 606 for black is configured as described below. That is, the toner supply apparatus 606 includes the toner container 110 which is attachable and detachable, a toner cartridge tray 221, a toner cartridge driving device 205, a small door 213, a locking device 206, an internal cover 224, and an attachment portion 212. The toner cartridge tray 221 is capable of guiding the toner container 110 to the image forming apparatus 200 at an attachment of the toner container 110 and holding the toner container 110 after attached. The toner cartridge driving device 205 is capable of drivingly rotating the toner container 110, and, by rotating, the toner container 110 is capable of conveying (supplying) the toner in the toner container 110 to the developing unit 603 (refer to FIG. 9).

As shown in FIG. 11B, an attachment/detachment port 224*a*, which is an example of an opening portion corresponding to each color of the toner cartridge, is provided in the internal cover 224, and the attachment and detachment of the toner container 110 to and from the attachment portion 212 is performed in a front-back direction of the forward F and the backward B through the attachment/detachment port 224*a*. To be noted, FIG. 11B shows a case of the toner container 110 of black, and cases of toner cartridges of other colors are similar to this. The small door 213 is an example of a first cover and the door used for a replacement of the toner cartridge, and the door to open and close the attachment/detachment port 224*a*, and the attachment and detachment of the toner container 110 is possible only when the small door 213 is opened. The locking device 206, which is an example of the opening portion, is capable of performing a lock of the small door 213 in the closed state and disengaging the lock, and receives a drive force to disengage the lock from the toner cartridge driving device 205. The small door 213 is disposed immediately inside the front cover 270, and an opening and closing operation of the small door 213 is allowed only when the front cover 270 is in the open state. An opening and closing of the front cover 270 is detected with an opening/closing detection sensor 271 (refer to FIG. 10B), which is an example of a second opening/closing detection unit. Hereinafter, a detail configuration of each constituent of the toner supply apparatus 606 will be described.

Toner Cartridge Driving Device

Figure 12:
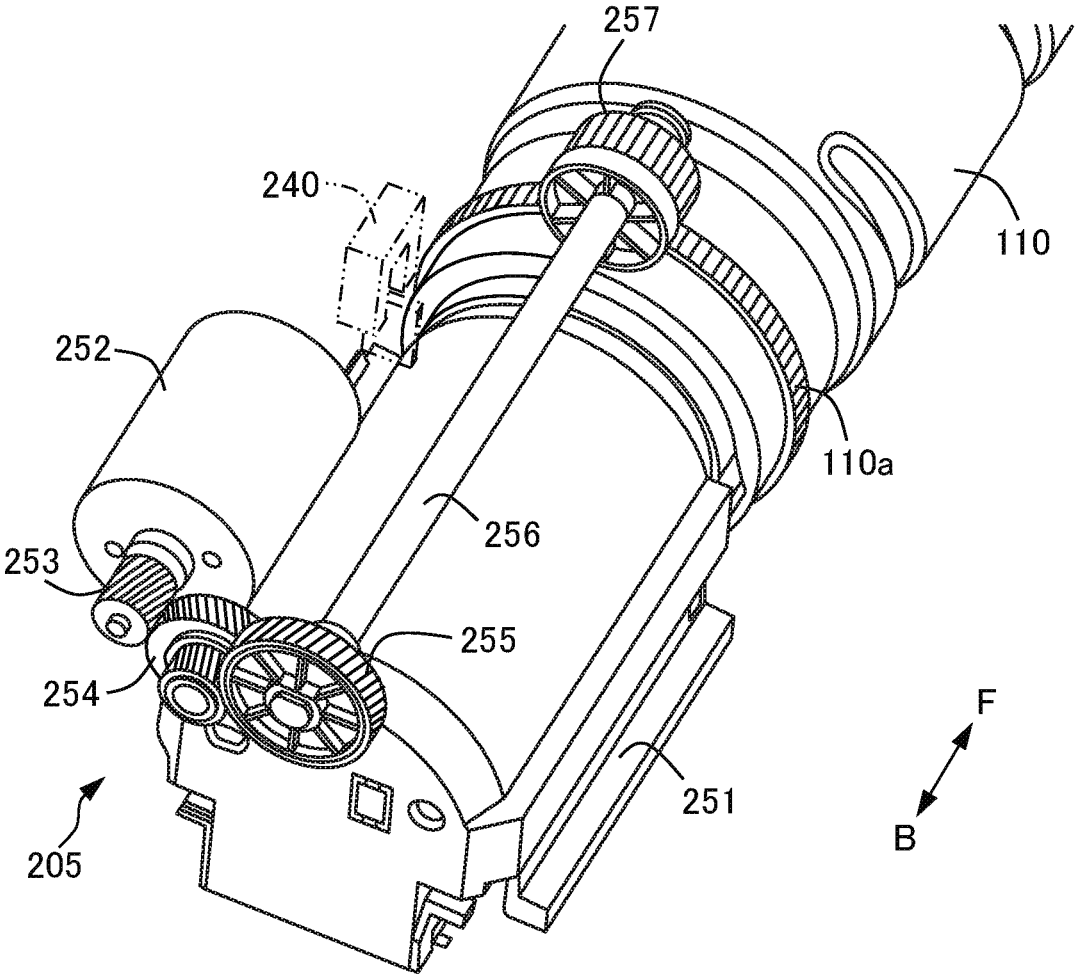
FIG. 12 is a perspective view of a toner cartridge driving device according to the second embodiment.
Figure 13:
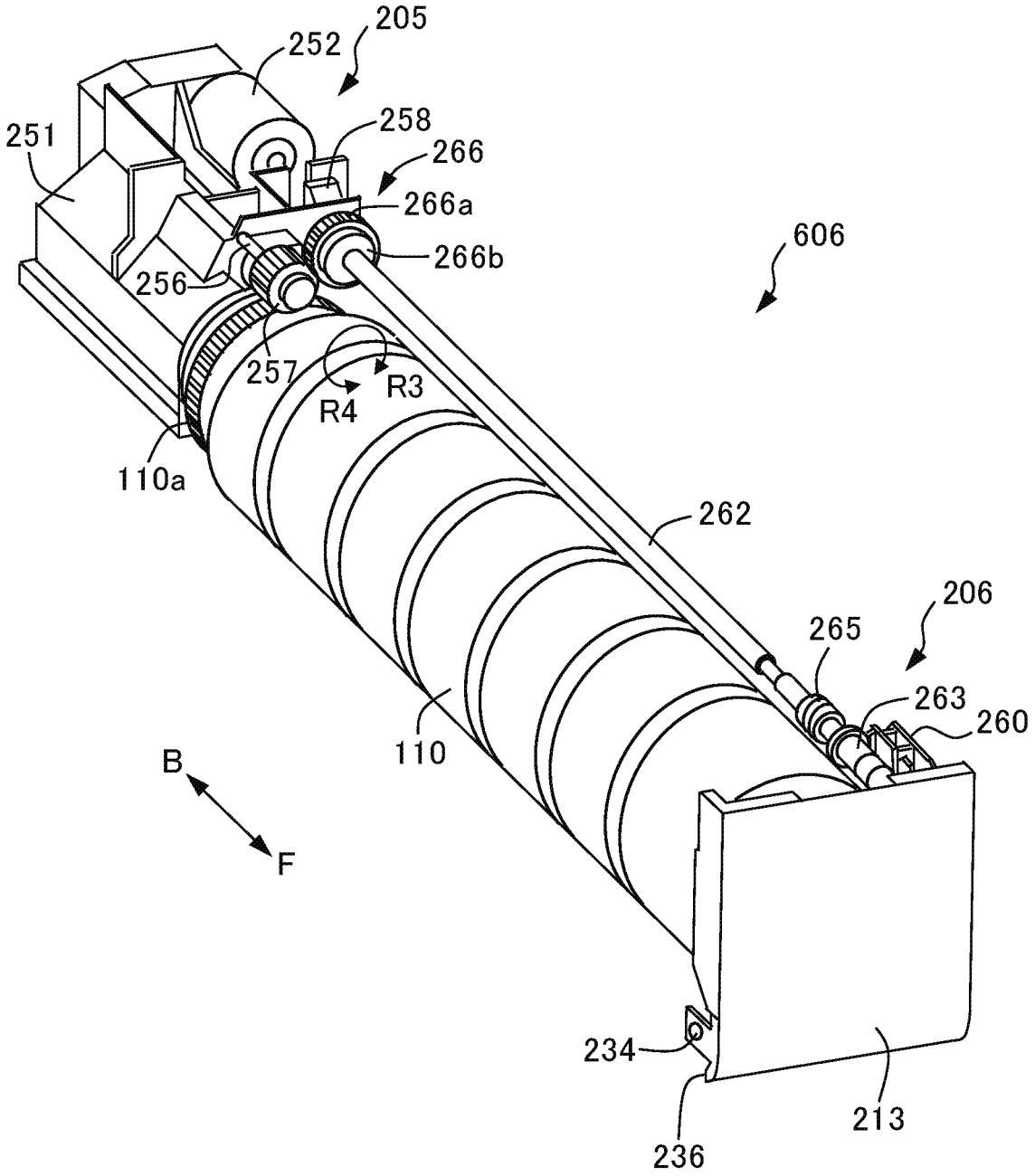
FIG. 13 is the perspective view of the toner supply unit according to the second embodiment.

As shown in FIGS. 12 and 13, the toner cartridge driving device 205 includes such as a base 251, a driving motor 252, a pinion gear 253, a speed reduction gear 254, a transmission gear 255, a transmission shaft 256, a driving gear 257, a small door opening/closing sensor 258. The driving motor 252 consists of an electric motor, which is an example of a driving unit, and is fixed to the base 251, and the pinion gear 253 is pressed into a rotation shaft of the driving motor 252. The speed reduction gear 254 is rotatably supported with respect to the base 251, and disposed at a position where the speed reduction gear 254 engages with the pinion gear 253 and the transmission gear 255. Herewith, a driving force is transmitted from the pinion gear 253 to the transmission gear 255. The transmission shaft 256 is rotatably supported with the base 251, and fixes each of the transmission gear 255 and the driving gear 257 to a different edge thereof, and couples the transmission gear 255 and the driving gear 257 together. Incidentally, the transmission shaft 256 is disposed along the front-back direction. Further, the driving gear 257 is disposed upstream of the transmission gear 255 and the driving motor 252 in the front-back direction, that is, on the forward F.

The small door opening/closing sensor 258 (refer to FIG. 13) is, for example, an optical sensor having a light emitting component and a photo sensing portion to receive a light from the light emitting component. The small door opening/closing sensor 258 is capable of detecting a position of a shaft 262, described later, by detecting whether or not the shaft 262 blocks the light between the light emitting component and the photo sensing portion (refer to FIGS. 15A to 15C). The small door opening/closing sensor 258 is the sensor which detects an opening and closing of the small door 213 by detecting the position of the shaft 262 in an axial direction, and will be described in detail in a description of a lock mechanism described later.

A rotary drive of the driving motor 252 is transmitted to the driving gear 257 via the pinion gear 253, the speed reduction gear 254, the transmission gear 255, and the transmission shaft 256. In a case where the toner container 110 is attached to the attachment portion 212A, a cartridge gear 110*a* and the driving gear 257 included in the toner container 110 are disposed at a position to engage each other, and the toner container 110 is rotated by a rotation of the driving gear 257. To be noted, a rotation direction of the driving gear 257 is such that the driving gear 257 rotates the toner container 110 in an R3 rotation direction, which is a first rotation direction, to supply the toner to the developing unit 603. That is, the driving gear 257 is coupled to the driving motor 252, and, by rotating the toner container 110 fitted in the attachment portion 212 in the R3 rotation direction, is capable of feeding the developer from the toner container 110. An attachment detection sensor 240, which is an example of an attachment detection unit, blocks a light path of the sensor in a case where the toner container 110 is attached to the toner cartridge tray 221. Herewith, it is possible to detect whether or not the toner container 110 is attached to the toner supply apparatus 606.

Small Door

Figure 14:
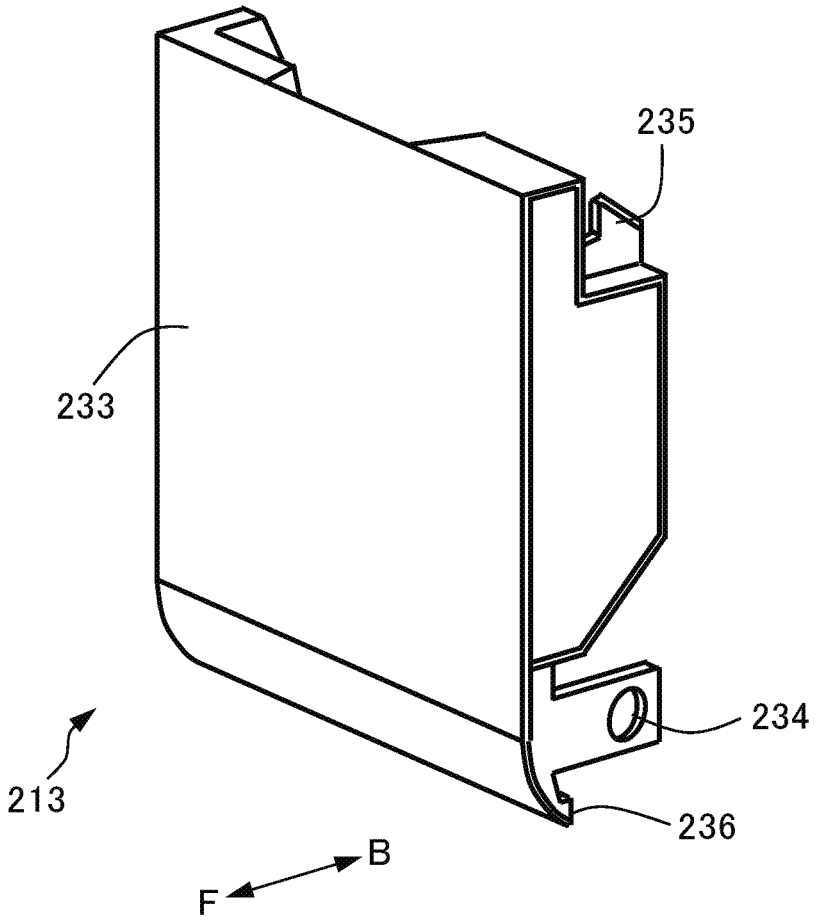
FIG. 14 is a perspective view of the small door according to the second embodiment.

Next, using FIGS. 14 to 15C, the small door 213 will be described. The small door 213 includes a door body 233, a pair of center holes 234, a claw portion 235, and a rotation stopper portion 236. The pair of center holes 234 are disposed on a left and right as a pair, and rotatably engaged with a rotation shaft 237 included in the internal cover 224, and herewith the small door 213 is rotatably supported with the internal cover 224. To be noted, in a state where the small door 213 stands upright (refer to FIG. 14), a weight center of the small door 213 is on the forward F with respect to a center line connecting the pair of the center holes 234. Accordingly, the small door 213 is rotatably supported with respect to the pair of the center holes 234, and in a case where an external force is absent, falls to the forward F under its own weight thereof and is opened. Thus, it is possible to eliminate a need to provide a dedicated spring member to open the small door 213.

Figure 15A:
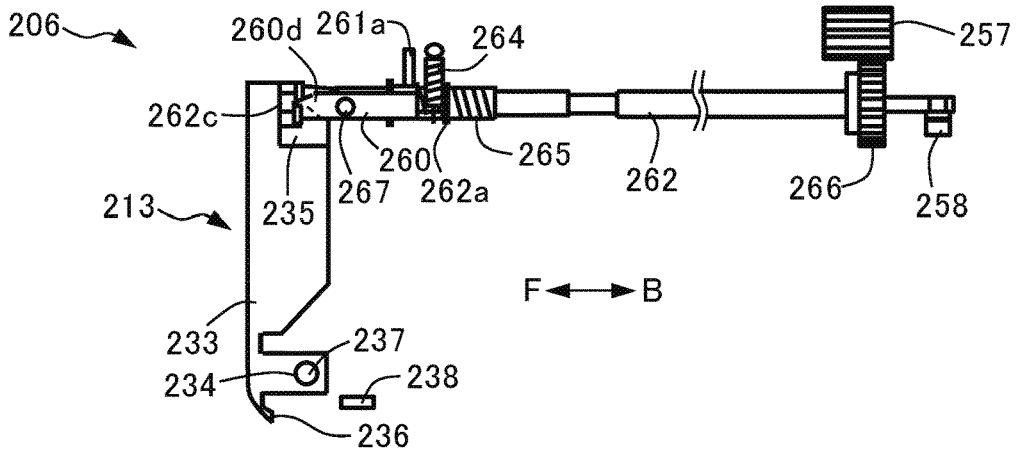
FIG. 15A is a side view of a locking unit according to the second embodiment with the small door closed.
Figure 15B:
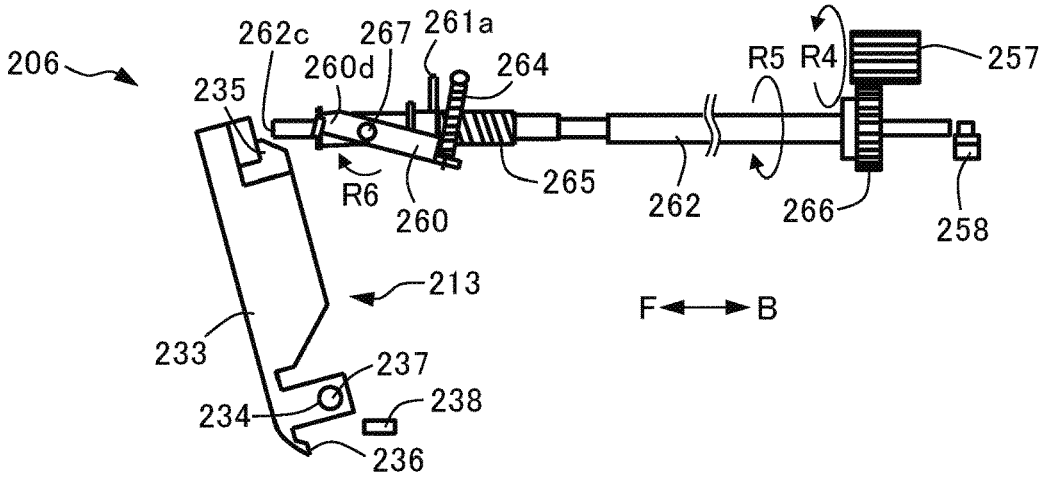
FIG. 15B is the side view of the locking unit according to the second embodiment with the small door slightly opened.

As shown in FIG. 15A, when the small door 213 is in a closed state, the claw portion 235 engages with a locking portion 260*d* on the forward F of a latch 260, described later. Therefore, the small door 213 is held in the closed state without swinging toward the internal cover 224 (refer to FIG. 11A). To be noted, the latch 260 is a component constituting the lock device 206, and will be described in detail in a description of the locking device 206. As shown in FIG. 15B, when the latch 260 swings and an engagement of the locking portion 260*d* of the latch 260 with the claw portion 235 is disengaged, the small door 213 becomes capable of swinging. At this time, since the weight center of the small door 213 is on a side of opening the small door 213, when the engagement of the latch 260 with the claw portion 235 is disengaged, the small door 213 swings in the opening direction under the own weight thereof. As shown in FIG. 15C, the small door 213 swings until reaching to a position where the rotation stopper portion 236 abuts on a stopper 238 disposed in the internal cover 224, and a posture of the small door 213 at a time of abutting is defined. In this state, the small door 213 is maximally opened.

Lock Device

Figure 16:
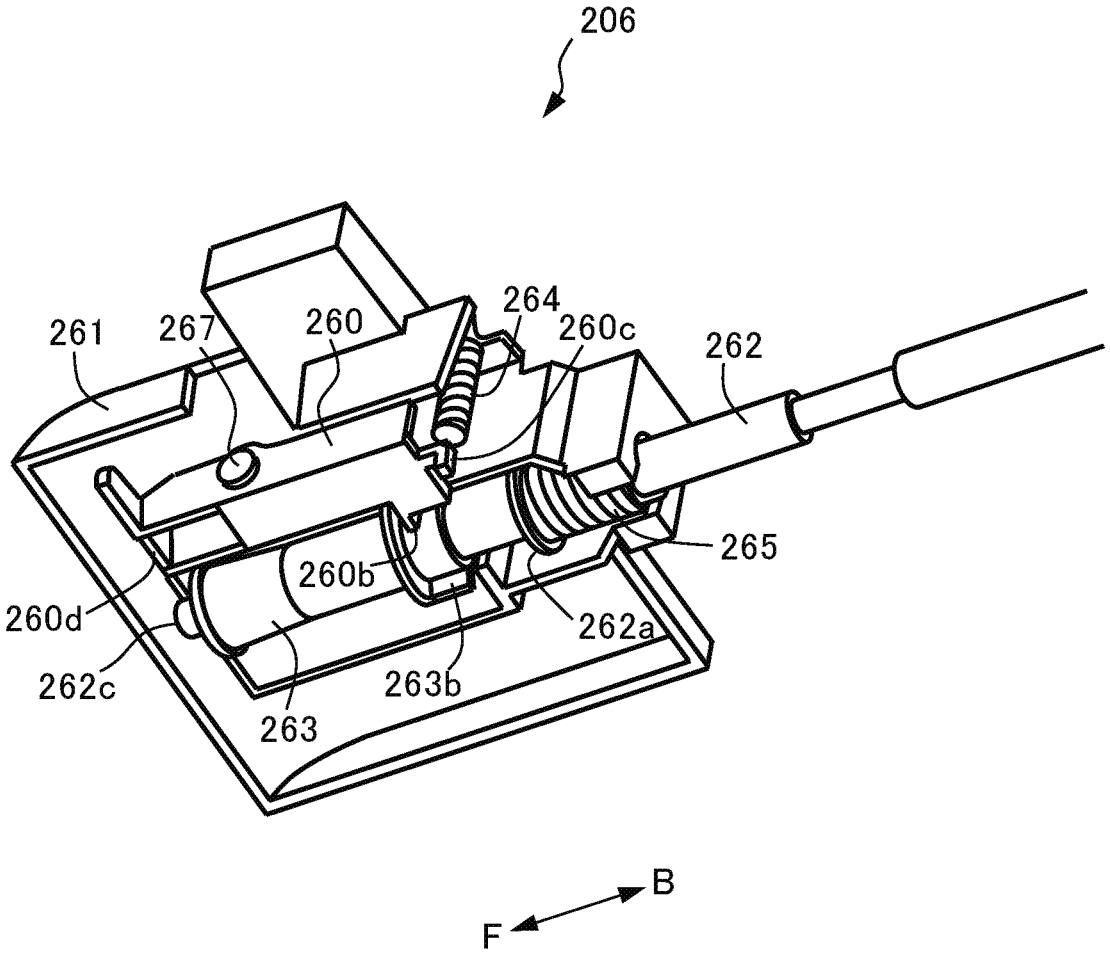
FIG. 16 is a perspective view of the locking unit according to the second embodiment.
Figure 17:
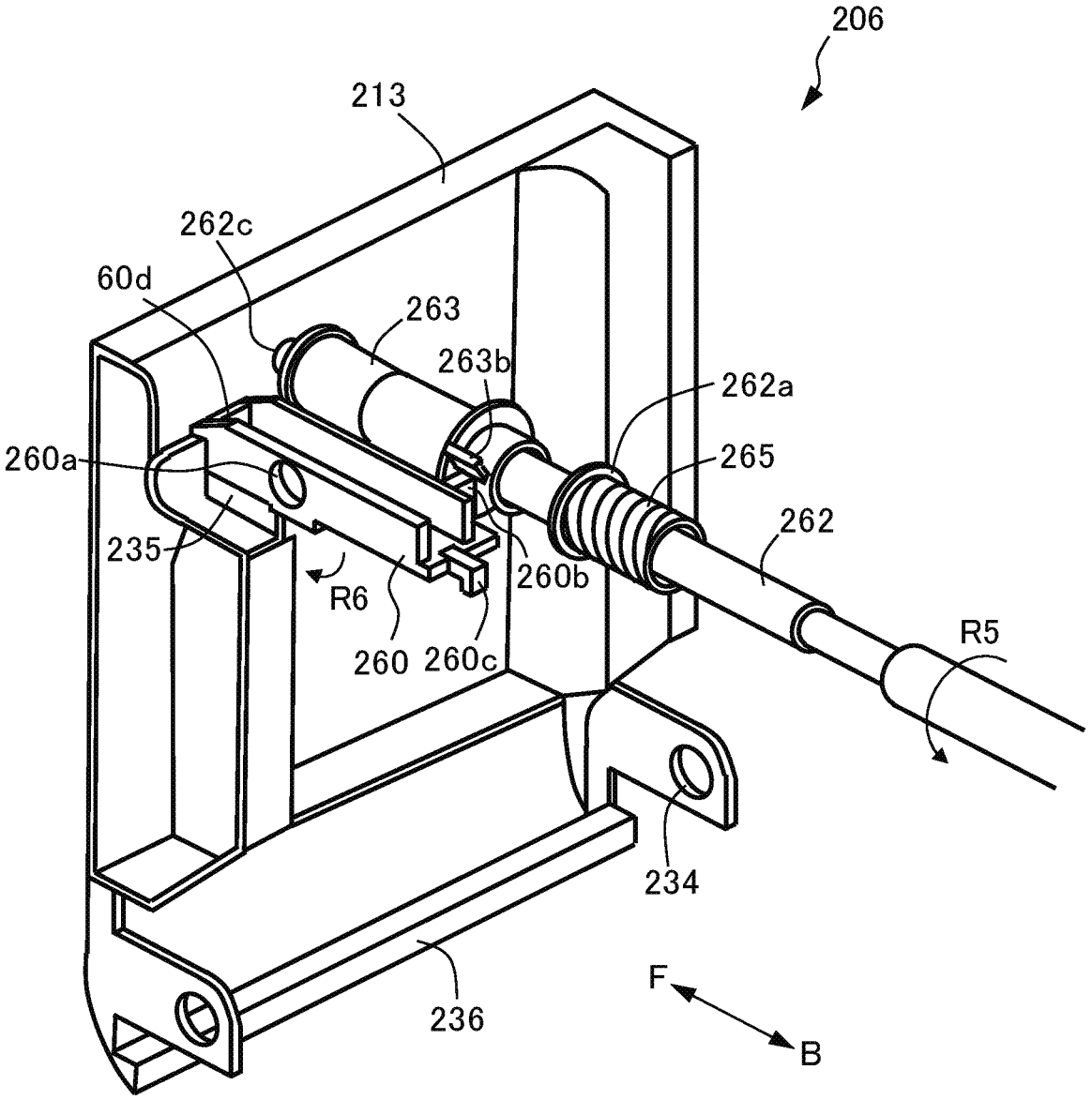
FIG. 17 is the perspective view of the locking unit according to the second embodiment viewied from another angle.

Next, with referring to FIGS. 16 to 19B, the locking device 206 will be described. As shown in FIGS. 16 and 17, the locking device 206 includes the latch 260, a base 261, the shaft 262, a latch driving unit 263, a latch spring 264, a shaft spring, i.e., shaft urging portion, 265, a one-way gear 266 (refer to FIG. 15A). The shaft, i.e., rotation shaft, 262, which is rotatable by a driving force from the driving motor 252, and the latch driving unit, i.e., sleeve, 263 of a cylindrical shape, which is slidably disposed on a circumference of the shaft 262, forms a transmission unit, which is rotatable by a driving force from the driving motor 252. Further, the transmission unit is disposed such that a direction of a rotational axis thereof is along the front-back direction which is the insert direction to fit the toner container 110 into the attachment portion 212. To be noted, the base 261 is fixed to an upper portion of the internal cover 224 (refer to FIG. 11A), but an illustration of the base 261 is omitted in FIG. 17.

A longitudinal direction of the latch 260, as a locking unit, is the front-back direction, and the latch 260 is supported approximately at a center in the front-back direction with a swing shaft 267 in a manner capable of swinging with respect to the base 261. The latch 260 includes a swing hole 260*a* supported with the swing shaft 267 in a manner capable of swinging, an engaged portion 260*b* disposed on the backward B, and a hook 260*c* disposed on the forward F. A center line of the swing shaft 267 is along a left to right direction of an apparatus body 210, and the swing shaft 267 is fixed to the base 261. That is, the swing shaft 267 is disposed between the locking portion 260*d* and the engaged portion 260*b*, and makes the latch 260 capable to swing around a rotational axis direction perpendicularly intersecting with a rotational axis direction of the shaft 262, which is the front-back direction. To be noted, the latch 260 and the swing shaft 267 form a locking portion.

The latch 260 is supported with the base 261 in a manner capable of swinging, and the hook 260*c* is stretched with the latch spring 264 which consists of a tension spring and works as a locking urging portion. A lower and an upper edge of the latch spring 264 are respectively fixed to the hook 260*c* and the base 261, and the latch spring 264 urges the backward B of the latch 260 upward.

The shaft 262 is supported rotatably and movably along a rotational axis direction thereof with the base 261 in adjacencies of an edge on the forward F. In adjacencies of an edge on the backward B of the shaft 262, the one-way gear 266 (refer to FIG. 15A) is fixed. The shaft spring 265 consists of a compression spring, and an edge on the forward F thereof abuts on a flange portion 262*a* fixed to the shaft 262, and an edge of the shaft spring 265 on the backward B abuts on the base 261 (refer to FIG. 16). Herewith, the shaft spring 265 urges the shaft 262 toward the small door 213 along the rotation direction of the shaft 262, and with respect to the base 261 the shaft 262 is always urged toward the forward F.

Figure 18:
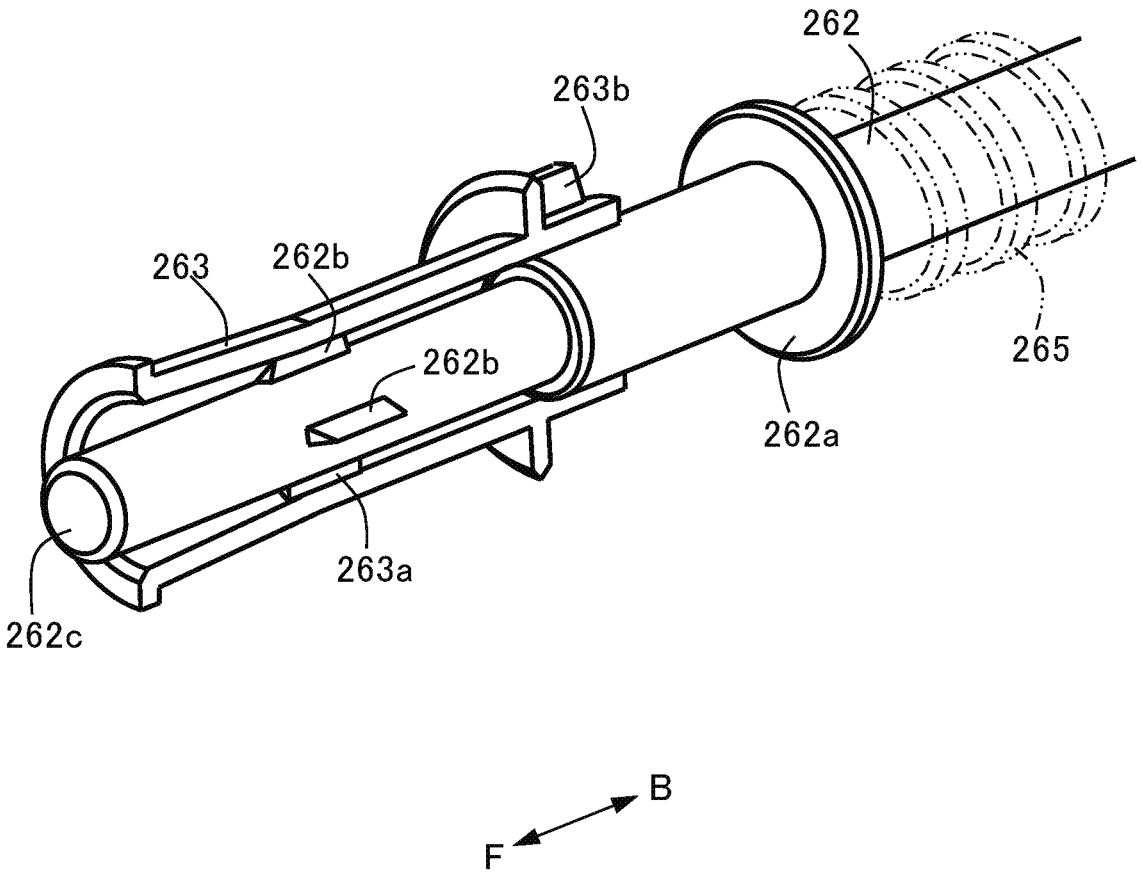
FIG. 18 is a perspective view showing a shaft and a latch driving unit of the locking unit according to the second embodiment.

The latch driving unit 263 having a shape of the sleeve is slidably held on the circumference of the shaft 262, and is disposed such that a position thereof is fixed in an axial direction with respect to the base 261. As shown in FIG. 18, the latch driving unit 263 has an approximately cylindrical shape, and held by the shaft 262 passing through inside the latch driving unit 263 of the cylinder shape. On a circumferential surface of the shaft 262, an engagement protrusion, i.e., first protrusion, 262*b* is disposed. On an inner circumferential surface of the latch driving unit 263 an engaged protrusion, i.e., second protrusion, 263*a*, which is capable to engage with the engagement protrusion 262*b* in a rotation direction, is disposed (refer to FIG. 19A), and on a circumferential surface of the latch driving unit 263 an engagement portion 263*b* is disposed. The engagement portion 263*b* protrudes in a radial direction on a circumference of the latch driving unit 263.

Figure 19A:
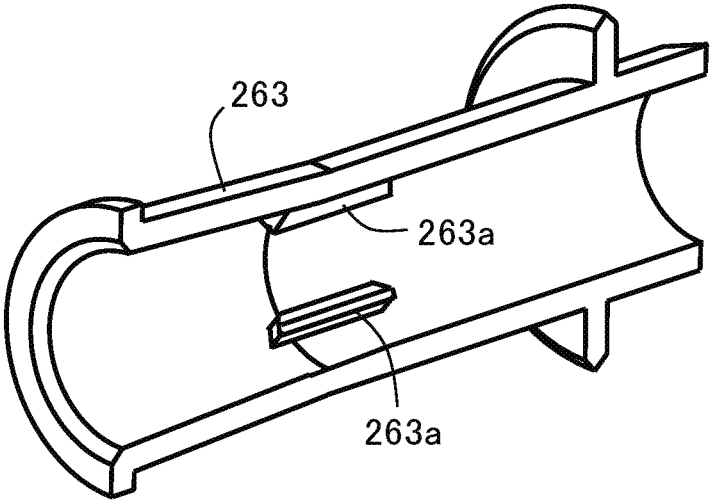
FIG. 19A is a perspective view of the latch driving unit according to the second embodiment.
Figure 19B:
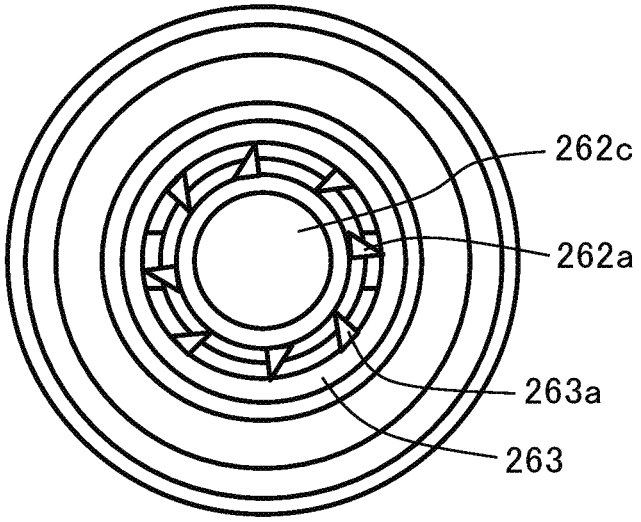
FIG. 19B is a front view showing the shaft and the latch driving unit according to the second embodiment.

As shown in FIG. 19B, shapes of the engagement protrusion 262*b* and the engaged protrusion 263*a* are similar to shapes of an internal tooth and external tooth of a gear, and by engaging each other a rotary drive of the shaft 262 is transmitted to the latch driving unit 263 in synchronizing each other. To be noted, the shaft 262 is slidable to the latch driving unit 263 in the axial direction thereof. Therefore, a transmission of the rotary drive is limited to a case where the engagement protrusion 262*b* and the engaged protrusion 263*a* overlap each other at least partially, such as a case of the small door 213 being in the closed state (refer to FIG. 15A). In a case where the engagement protrusion 262*b* and the engaged protrusion 263*a* do not overlap each other entirely, such as a case of the small door 213 being in the open state (refer to FIG. 15B), the rotary drive is not transmitted. That is, the latch driving unit 263 is movable to a first position (refer to FIG. 15A) and a second position (refer to FIG. 15B) along the rotational axis direction. The first position is a position where the engagement protrusion 262*b* and the engaged protrusion 263*a* engage each other in the rotation direction. On the other hand, the second position is the position where the engagement protrusion 262*b* and the engaged protrusion 263*a* do not engage each other in the rotation direction. The shaft 262 is configured to relatively move in the rotational axis direction of the shaft 262 with respect to the latch driving unit 263, and, by a relative movement in the rotational axis direction, relative positions of the shaft 262 and the latch driving unit 263 is switched between an engaging position where the shaft 262 and the latch driving unit 263 engage each other and rotate integrally and a disengaging position where the shaft 262 and the latch driving unit 263 does not engage each other and rotate idly.

Figure 15C:
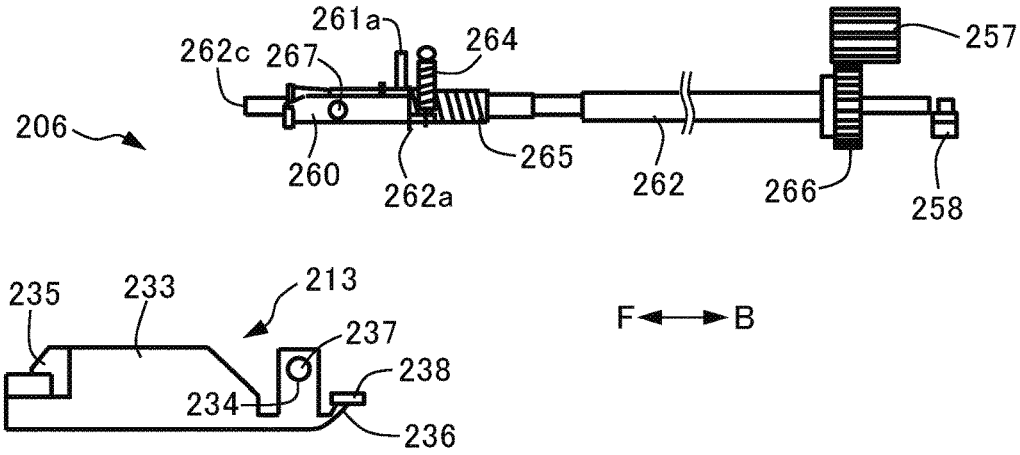
FIG. 15C is the side view of the locking unit according to the second embodiment with the small door maximally opened.

Further, in a case where the small door 213 is in the closed state, the latch driving unit 263 is at the first position (refer to FIG. 15A), and in a case where the small door 213 is in the open state, the latch driving unit 263 is at the second position (refer to FIGS. 15B and 15C). To be noted, when the latch driving unit 263 moves from the second position to the first position in the axial direction, there is a possibility that the engagement protrusion 262*b* and the engaged protrusion 263*a* abut each other in the axial direction and prevent a movement of the latch driving unit 263. Therefore, in this embodiment, a taper is formed on a facing surface of an at least one of the engagement protrusion 262*b* and the engaged protrusion 263*a* in the axial direction so that the engagement protrusion 262*b* and the engaged protrusion 263*a* circumvent each other in the rotational direction when the engagement protrusion 262*b* and the engaged protrusion 263*a* abut each other.

Assembly of the lock device 206 to the apparatus body 210 is performed such that the base 261 is fixed to the internal cover 224, and the edge of the shaft 262 on the backward B is held with the base 261 rotatably and movably in the axial direction. As shown in FIGS. 15A to 15C, the one-way gear 266 always engages with the driving gear 257 regardless of a position of the shaft 262 in the axial direction. The edge of the shaft 262 on the backward B is, by a movement of the shaft 262 in the axial direction, capable of displacing between a position, where the shaft 262 blocks a detection area of the small door opening/closing sensor 258 (refer to FIG. 15A), and a position, where the shaft 262 retreats from the detection area of the small door opening/closing sensor 258 (refer to FIG. 15B).

As shown in FIG. 13, the one-way gear 266 includes a driven gear 266*a* which engages with the driving gear 257, and a one-way clutch 266*b* fixed to the shaft 262. In a case where the driving gear 257 rotates in the R3 rotation direction, the driven gear 266*a* is idly rotated around the shaft 262 with this one-way clutch 266*b*, and in a case where the driving gear 257 rotates in an R4 rotation direction, which is a second rotation direction opposite to the R3 rotation direction, the driven gear 266*a* transmits the rotary drive to the shaft 262 with the one-way clutch 266*b*, and the shaft 262 is driven. That is, the one-way clutch 266*b* is interposed between the driven gear 266*a* and the shaft 262, and disposed on a power transmission path between the driving motor 252 and the toner container 42. To be noted, since the toner is supplied from the toner container 110 to the developing unit 603 when the driving gear 257 is rotated in the R3 rotation direction, the one-way gear 266 idly rotates when the toner is supplied from the toner container 110 to the developing unit 603. Further, when the driving gear 257 is rotated in the R4 rotation direction which is opposite to the rotation direction of supplying the toner, the rotary drive is transmitted to the shaft 262 and the lock in the closed state of the small door 213 is disengaged.

Opening/Closing Movement of Small Door

Next, a series of movements of the locking device 206 to open and close the small door 213 will be described with referring to FIGS. 15A to 15C. As shown in FIG. 15A, when the small door 213 is in the closed state, since the claw portion 235 disposed in the small door 213 is held with the locking portion 260*d* of the latch 260, the small door 213 does not swing and is held in the closed state. That is, the latch 260 is capable of holding the small door 213 in the closed state, and the locking portion 260*d* is capable of engaging with the small door 213, and lock the small door 213 in the closed state. A position of the latch 260 at this time is an original position, and the latch 260 is held at the original position unless an external force is provided since the latch 260 is urged in a direction to lock the small door 213 with the latch spring 264.

The shaft 262 is urged to the forward F of the apparatus body 210 with the shaft spring 265, and the position of the shaft 262 in the axial direction is defined by a front edge 262*c* of the shaft 262 abutting on the small door 213 in the closed state. That is, the shaft spring 265 urges the shaft 262 toward the small door 213 along the rotational axis direction. At this time, the edge of the shaft 262 on the backward B is at a position of blocking the detection area of the small door opening/closing sensor 258, and a control unit 400 judges that the small door 213 is in the closed state. Further, the latch driving unit 263 is at the first position in the axial direction, and the engagement protrusion 262*b* of the shaft 262 and the engaged protrusion 263*a* of the latch driving unit 263 are at the engagement position in the rotation direction (refer to FIG. 18). Therefore, the shaft 262 and the latch driving unit 263 are at the relative positions where it is possible to transmit the driving force in the rotation direction by synchronizing each other.

As shown in FIG. 15B, for opening the small door 213, the driving gear 257 is rotated in the R4 rotation direction by driving the driving motor 252 (refer to FIG. 13). By the rotation of the driving gear 257, the rotary drive is transmitted to the one-way gear 266 and the shaft 262, and the shaft 262 is rotated in an R5 rotation direction. At this time, since the shaft 262 and the latch driving unit 263 are at the relative positions where the rotary drive is transmitted, the latch driving unit 263 is also rotated in the R5 rotation direction. By the rotation of the latch driving unit 263, the engagement portion 263*b* pushes down the engaged portion 260*b* of the latch 260, and the latch 260 swings in an R6 rotation direction, and the claw portion 235 of the small door 213 are disengaged from the locking portion 260*d* of the latch 260. That is, the engagement portion 263*b* and the engaged portion 260*b* engage each other by the rotation of the shaft 262 and the latch driving unit 263. Thus, a locked state where the small door 213 is locked in the closed state (refer to FIG. 15A) is switched to an unlocked state where the closed state of the small door 213 is unlocked (refer to FIGS. 15B and 15C). Thus, the small door 213 starts to swing toward an opening direction under the own weight thereof.

Since a thrust position regulation of the front edge 262*c* by the small door 213 is removed, the shaft 262 moves to the forward F in the rotational axis direction with the shaft spring 265. That is, when the engagement portion 263*b* switches the latch 260 to the unlocked state, the small door 213 is pressed and brought to the open state with the shaft spring 265. To be noted, a force of the shaft spring 265 to move the shaft 262 along the axial direction provides an auxiliary force to swing the small door 213. That is, although the small door 213 swings under the own weight thereof, for example, there is a possibility that a foreign material is stuck in a moving part of the small door 213 and the small door 213 becomes difficult to swing under the own weight thereof. Even in these cases, since the force of the shaft spring 265 to move the shaft 262 along the axial direction works as a force to press the small door 213 in the opening direction thereof, it is possible to securely open the small door 213. Further, since the edge of the shaft 262 on the backward B is at a position separated from the detection area of the small door opening/closing sensor 258, the control unit judges that the small door 213 is in the open state.

Further, as shown in FIG. 15C, when the small door 213 is maximally opened, the shaft 262 which is removed of the positional regulation by the small door 213 moves in the axial direction until the flange portion 262*a* of the shaft 262 abuts on a regulation portion 261*a* disposed at the base 261. Thus, a position of the shaft 262 in the open state of the small door 213 is defined. At this time, since the latch driving unit 263 is at the second position in the axial direction and the engagement protrusion 262*b*, disposed at the shaft 262, and the engaged protrusion 263*a*, disposed at the latch driving unit 263, are out of alignment in the axial direction each other, the rotary drive is not transmitted. Since the latch driving unit 263 becomes rotatable without a driving force from the shaft 262 and a force to push down the engaged portion 260*b* of the latch 260 with the engagement portion 263*b* of the latch driving unit 263 is removed, the latch 260 returns to the original position with the latch spring 264. Along with the return of the latch 260 to the original position, the engaged portion 260*b* of the latch 260 pushes up the engagement portion 263*b* of the latch driving unit 263. Further, since the edge of the shaft 262 on the backward B is at a position separated from the detection area of the small door opening/closing sensor 258, the control unit 400 judges that the small door 213 is in the open state. As described above, since the small door 213 to which the toner container 110 of the target for the replacement is attached is automatically opened, it is possible for the user to identify the toner container 110 of the target without a mistake.

At a time of returning the small door 213 in the open state to the closed state again, the user closes the small door 213 in the open state with hands. At this time, the front edge 262*c* of the shaft 262 is pushed into the backward B with the small door 213, and the claw portion 235 pushes up the locking portion 260*d* of the latch 260 so that the claw portion 235 is engaged with the locking portion 260*d* and returns to a state shown in FIG. 15A. Since the edge of the shaft 262 on the backward B moves to the position to block the detection area of the small door opening/closing sensor 258, the control unit 400 judges that the small door 213 is in the closed state. At this point, since the shaft 262 and the latch driving unit 263 are different components and capable to perform relative movements in the axial direction from each other, the latch driving unit 263 barely moves in the axial direction. Therefore, regardless of a position of the shaft 262 in the axial direction and the open or closed state of the small door 213, relative positions of the engaged portion 260*b* of the latch 260 and the engagement portion 263*b* of the latch driving unit 263 in the axial direction barely change. Accordingly, it is possible to obviate an interruption of a swinging movement of the small door 213, which may be caused by an abutment of the engaged portion 260*b* of the latch 260 and the engagement portion 263*b* of the latch driving unit 263 in the axial direction when the small door 213 is brought from the open state to the closed state.

As described above, it is possible to control the opening movement of the small door 213 using a same driving source as the toner container 110. To be noted, when the toner container 110 is rotated to perform a normal supply movement, the small door 213 is not affected since the driving gear 257 is rotated in the R3 rotation direction shown in FIG. 13 and a driving force is not transmitted to the shaft 262.

Figure 20:
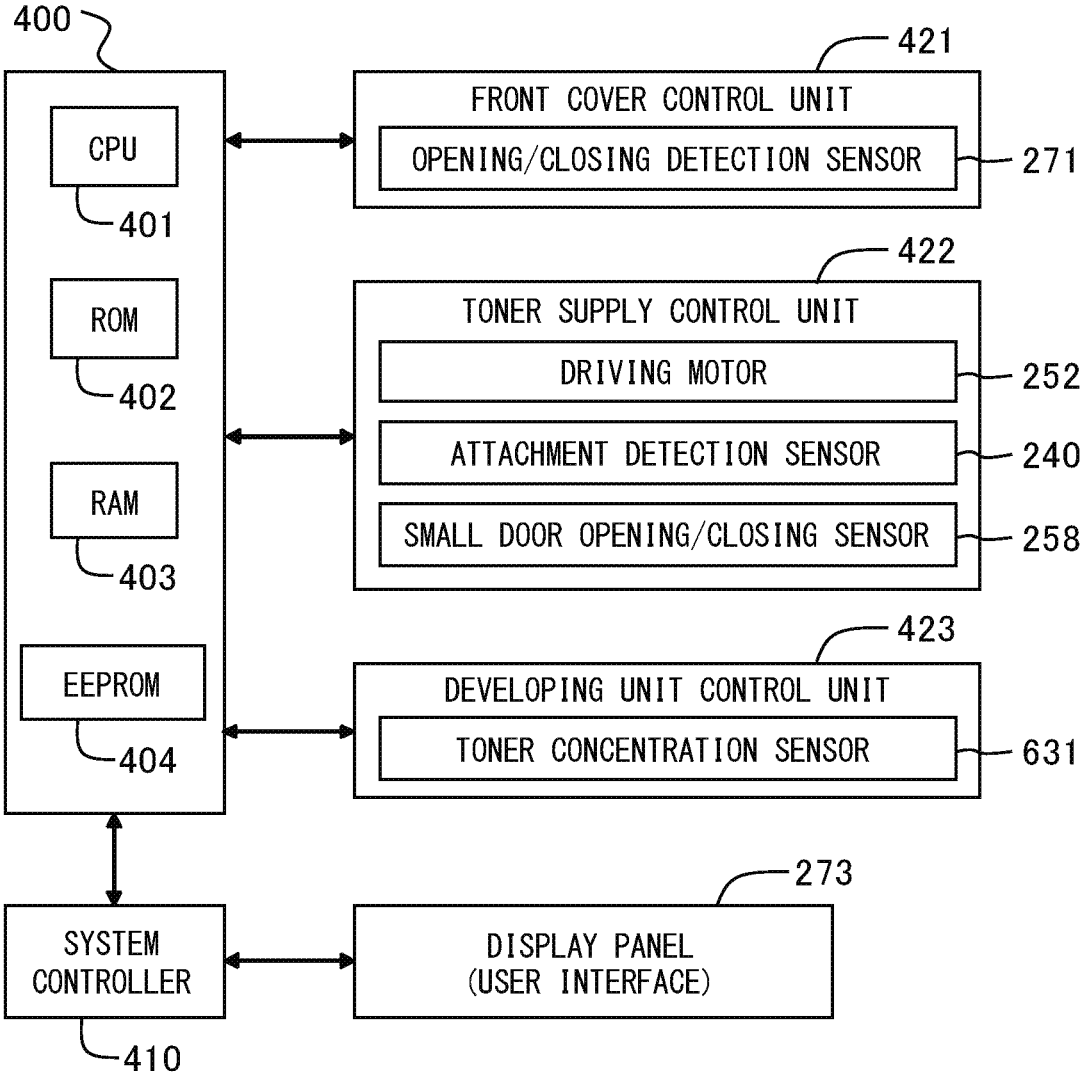
FIG. 20 is a block diagram showing a control system of the image forming apparatus according to the second embodiment.

Next, a control configuration of the toner supply apparatus 606 will be described. FIG. 20 is a block diagram showing the control configuration to control a movement of the toner supply apparatus 606. As shown in FIG. 20, the control unit 400 includes a CPU 401, a ROM 402, a RAM 403, and an electrically erasable programmable read-only memory (EEPROM) 404. The ROM 402 stores a control program to control a whole of the image forming apparatus 200. The RAM 403 is a volatile memory device used for a workspace of the CPU 401 and a temporary storage of various data such as image data. The EEPROM 404 is a nonvolatile memory device to store various data such as a residual quantity of the toner in the developing unit 603.

The CPU 401 controls the whole of the image forming apparatus 200 by executing the control program, which the CPU 401 reads out and sends to the RAM 403, stored in the ROM 402. The CPU 401 is electrically coupled to driving units such as a system controller 410, a front cover control unit 421, a toner supply control unit 422, and a developing unit control unit 423 via a control block or various drivers, not shown. The system controller 410 controls a display panel 273 which is an example of a display unit. The front cover control unit 421 detects and controls an opening and closing of the front cover 270. The toner supply control unit 422 controls a toner supply movement and an opening and closing of the small door 213. The developing unit control unit 423 controls such as a toner concentration in the developing unit 603. In this embodiment, a toner concentration sensor 631 consisting of, for example, an inductance sensor is disposed as an example of a residual quantity detection unit, and the toner concentration sensor 631 is capable of detecting the toner concentration in the developing unit 603, and the detection result thereof is sent to the developing unit control unit 423.

Flow of Movement of Small Door

Figure 21:
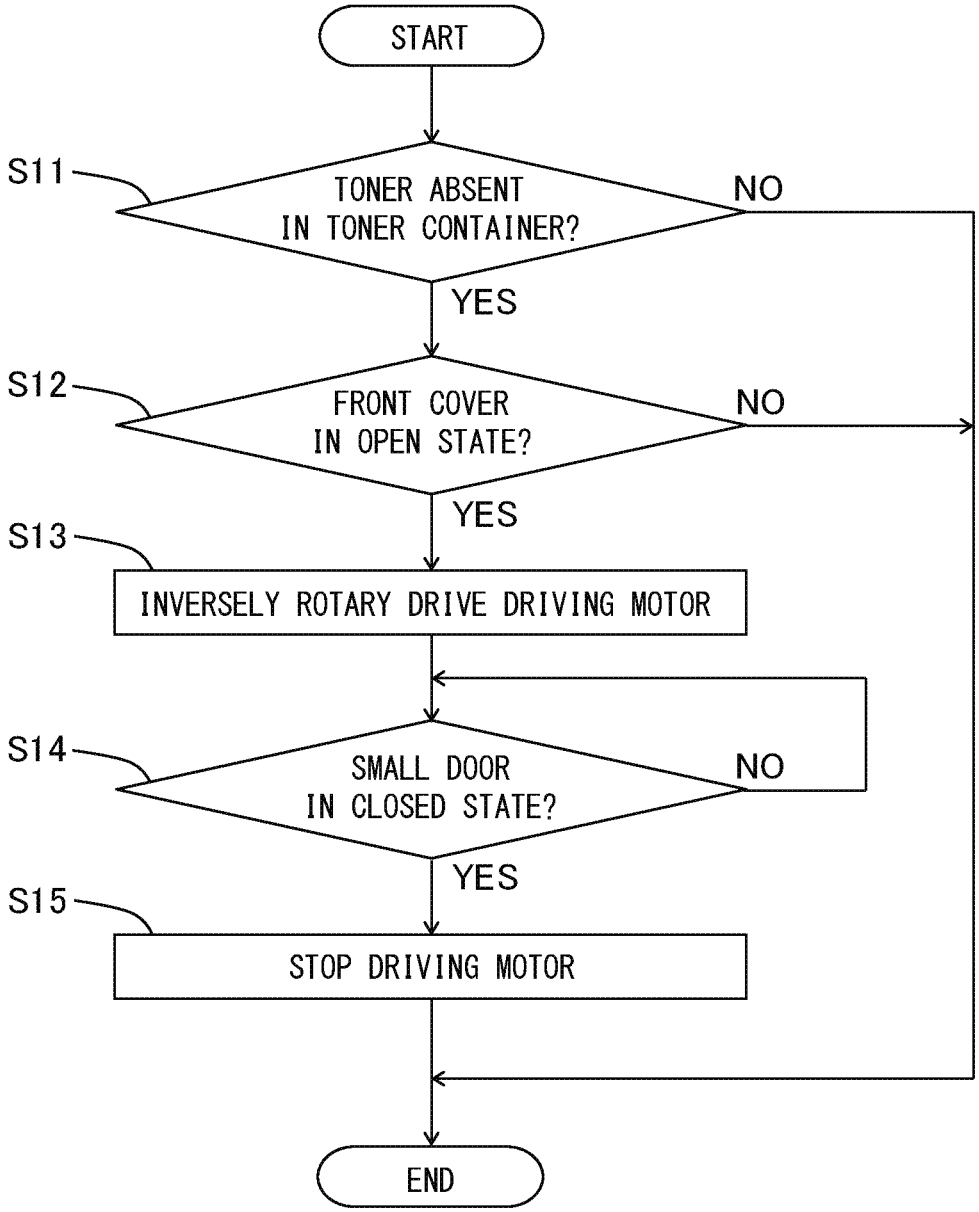
FIG. 21 is a flowchart showing a processing sequence to open the small door at a replacement of the toner container in the image forming apparatus according to the second embodiment.

Next, a control flow of a lock disengagement movement of the small door 213 will be described with reference to a flowchart illustrating a movement of the small door shown in FIG. 21. The CPU 401 judges whether or not the toner is absent in the toner container 110 of each color (step S11). For example, by estimating the toner concentration in the toner container 110 from the toner concentration in the developing unit 603 detected with the toner concentration sensor 631, the CPU 401 judges whether or not the toner is absent in the toner container 110. However, it is not limited to this method. For example, it is acceptable to measure a weight of the toner container 110, or acceptable to apply a method to estimate the residual quantity of the toner from a quantity per supply and number of times supplied. The CPU 401 ends processing when the toner in the toner container 110 is judged to be not absent (No at step S11).

In a case where the toner in the toner container 110 of any color is judged to be absent (YES at step S11), the CPU 401 starts the processing to replace the toner container 110 of the corresponding color. The CPU 401 judges with the cover opening/closing detection sensor 271 whether or not the front cover 270 is in the open state (step S12). In a case where the front cover 270 is judged to be not in the open state (NO at step S12), the CPU 401 ends the processing. In a case where the front cover 270 is judged to be in the open state (YES at step S12), the CPU 401 rotates the driving motor 252 of a station (color) corresponding to the toner container 110 of the target in an opposite direction (step S13). To be noted, a rotation direction in which the toner container 110 rotates in a normal toner supply operation is defined as a positive rotation, and a rotation direction to bring the small door 213 to the open state is defined as an inverse rotation.

The CPU 401 monitors the small door opening/closing sensor 258 of the target station for the replacement, and judges whether or not the small door 213 is brought from the closed state to the open state (step S14). In a case where the CPU 401 judges that the small door 213 is not in the open state (NO at step S14), the CPU 401 performs the judgement again (step S14). In a case where the CPU 401 judges that the small door 213 is in the open state (YES at step S14), the CPU 401 stops the driving motor 252 and ends the processing (step S15). Since, by the processing described above, the small door 213 to which the toner container 110 of the target for the replacement is attached is automatically opened, it is possible for the user to identify the target toner container without a mistake.

Figure 22:
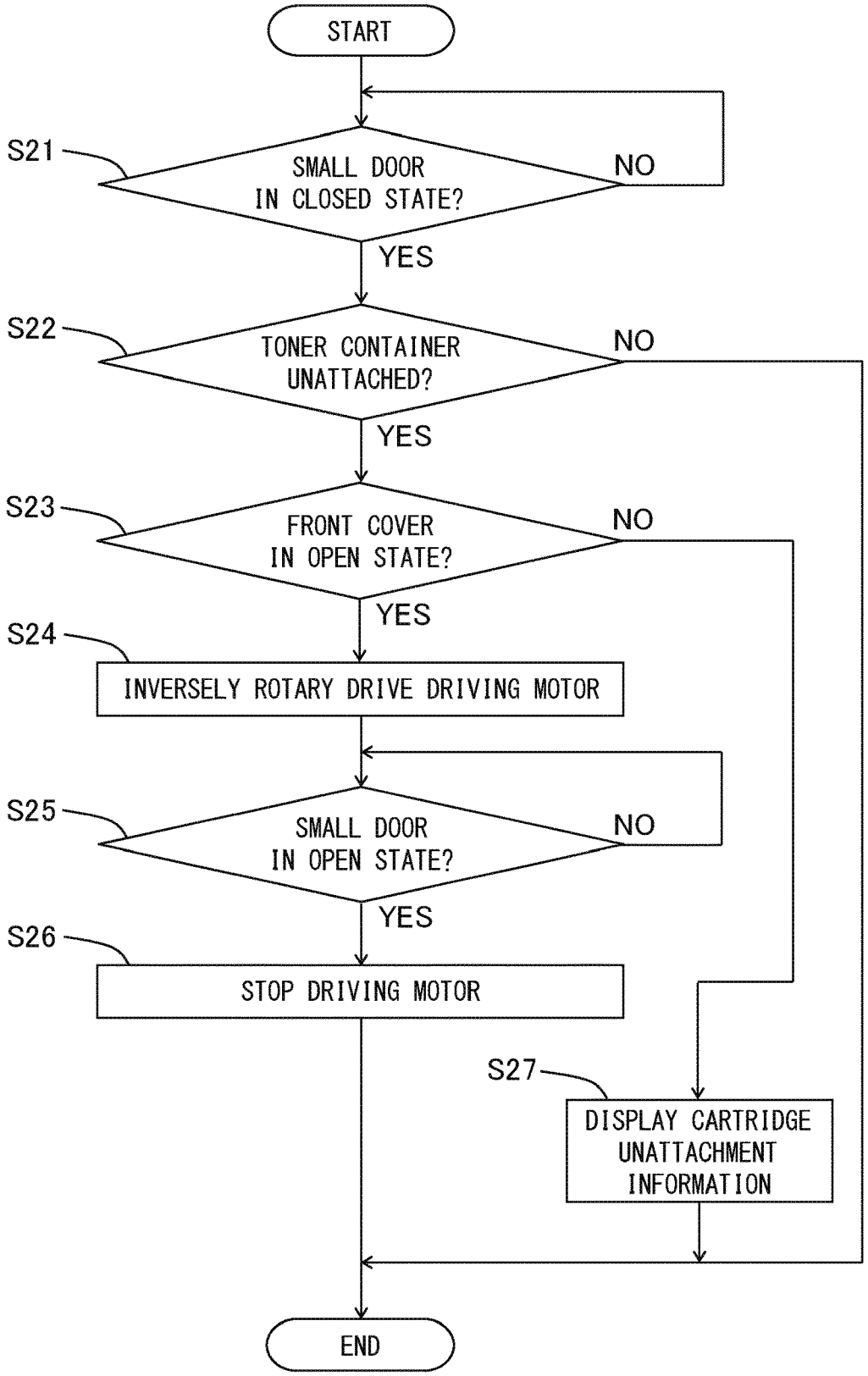
FIG. 22 is a flowchart showing a processing sequence to attach a toner container at the replacement of the toner container in the image forming apparatus according to the second embodiment.

Next, a movement flow to identify a state of the attachment of the toner container 110 will be described with reference to a flowchart illustrating a movement for identification of a toner container attachment shown in FIG. 22. The CPU 401 monitors the small door opening/closing sensor 258 of the target station for the identification, and judges whether or not the small door 213 is brought from the open state to the closed state (step S21). In a case where the CPU 401 judges that the small door 213 is not brought to the closed state (NO at step S21), the CPU 401 performs the judgement again (step S21). In a case where the CPU 401 judges that the small door 213 is brought to the closed state (YES at step S21), the CPU 401 judges whether or not the toner container 110 is unattached (step S22). In a case where the CPU 401 judges that the toner container 110 is not unattached (NO at step S22), the CPU 401 ends the processing.

In a case where the CPU 401 judges that the toner container 110 is unattached (YES at step S22), the CPU 401 judges with an opening/closing detection sensor 271 whether or not the front cover 270 is in the open state (step S23). In a case where the CPU 401 judges that the front cover 270 is in the open state (YES at step S23), the CPU 401 inversely rotates the driving motor 252 corresponding to the target station (step S24). The CPU 401 monitors the small door opening/closing sensor 258 of the target station for the replacement, and judges whether or not the small door 213 is brought from the closed state to the open state (step S25). In a case where the CPU 401 judges that the small door 213 is not brought to the open state (NO at step S25), the CPU 401 performs the judgement again (step S25). In a case where the CPU 401 judges that the small door 213 is brought to the open state (YES at step S25), the CPU 401 stops the driving motor 252 and ends the processing (step S26).

As described above, in a case where the user closes the small door 213 without attaching the toner container 110 at the replacement of the toner container 110 by a mistake, an unattachment of the toner container 110 is shortly detected, and once detected the small door 213 is immediately opened. Thus, it is possible for the user to return to an attachment work of the toner container 110 again without a waiting time. To be noted, as described above, when the toner container 110 is judged to be unattached, the small door 213 is immediately opened. Therefore, it barely occurs that the small door 213 is in the closed state with the toner container 110 unattached and also with the front cover 270 being in the closed state (NO at step S23). However, in a case where the aforementioned state occurs, for example, by closing the small door 213 and the front cover 270 at the same time, it is not possible to open the small door 213. Supposing that it is possible to open the small door 213 inside the front cover 270, it is not possible for the user to recognize that the small door 213 is in the open state since the front cover 270 is closed. Therefore, in this embodiment, in a case where the toner container 110 is unattached with the small door 213 and the front cover 270 being in the closed state, a message to inform the unattachment of the toner container 110 is displayed (step S27) on the display panel 273 (refer to FIG. 10A). Herewith, it is possible to inform the user of the state described above.

As described above, in the image forming apparatus 200 of the second embodiment, in a case where the user closes the small door 213 without noticing the unattachment of the toner container 110 at the replacement of the toner container 110, the small door 213 is automatically opened. Therefore, it is possible for the user to recognize the unattachment of the toner container 110 before closing the front cover 270. Herewith, in a case where the small door 213 is closed without attaching the toner container 110, it is possible to prevent a complicated work such as to open the front cover 270 again after closed the front cover 270 without noticing the unattachment, and an operability is improved at a time when the toner container 110 is unattached.

Further, in this embodiment, the mechanism to use the driving motor 252 which is a driving source to supply the toner from the toner container 110 is applied to disengage the lock in the closed state of the small door 213. Therefore, it is possible to prevent an increase in high price components of the driving unit, and, with a simple configuration and low cost, it is possible to achieve to perform the disengagement of the lock in a case where the small door 213 is locked in the closed state.

Third Embodiment

Next, a third embodiment of the present disclosure will be described in detail with referring to FIGS. 23 and 24. In the third embodiment, in a case where the small door 213 is closed a plurality of times, the small door 213 is held in the closed state, and the third embodiment is different from the second embodiment at this point. To be noted, descriptions overlapping with the second embodiment described above will be omitted herein by putting a same mark as in the second embodiment.

Figure 23:
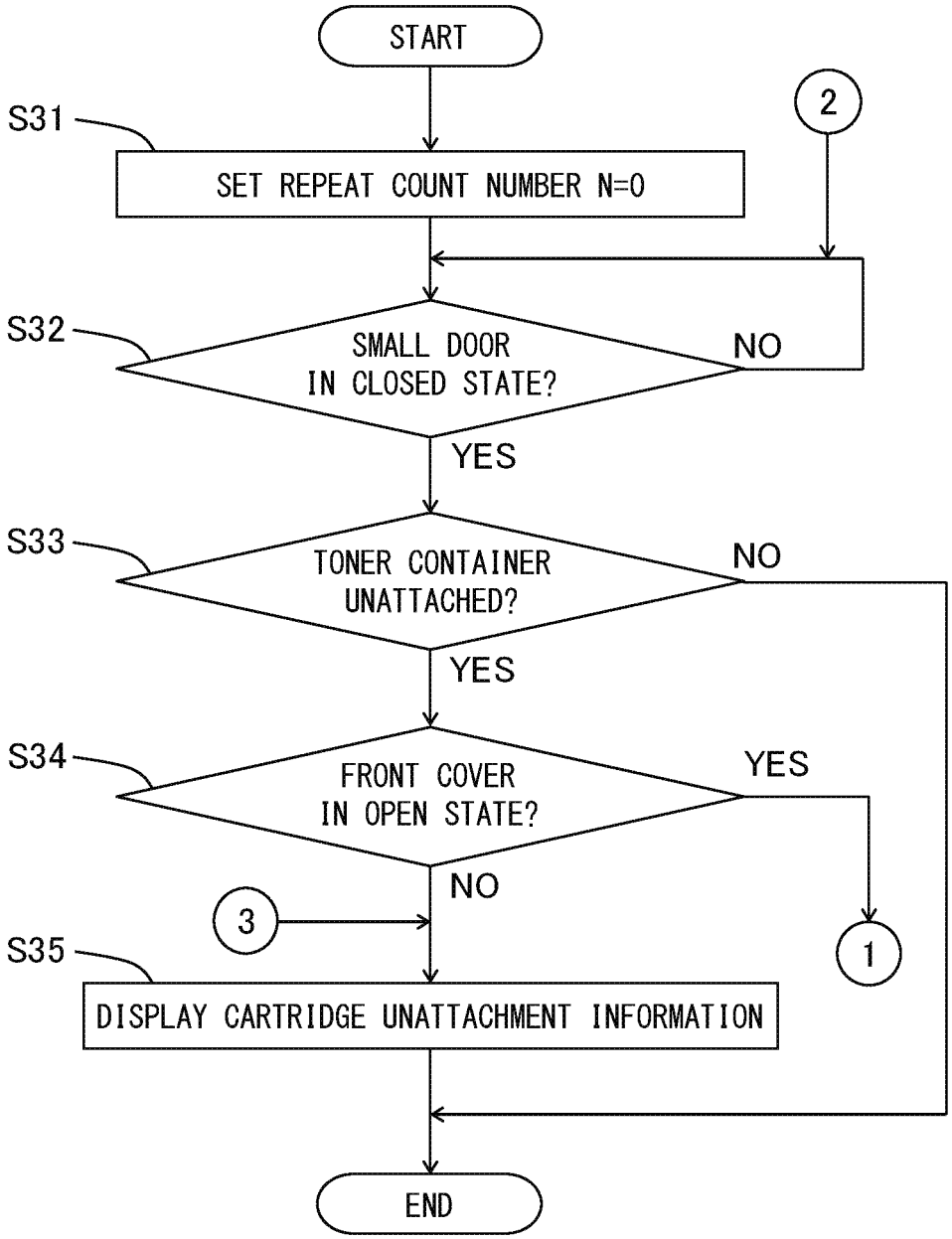
FIG. 23 is a first half of a flowchart showing a processing sequence to replace the toner container in the image forming apparatus according to a third embodiment.
Figure 24:
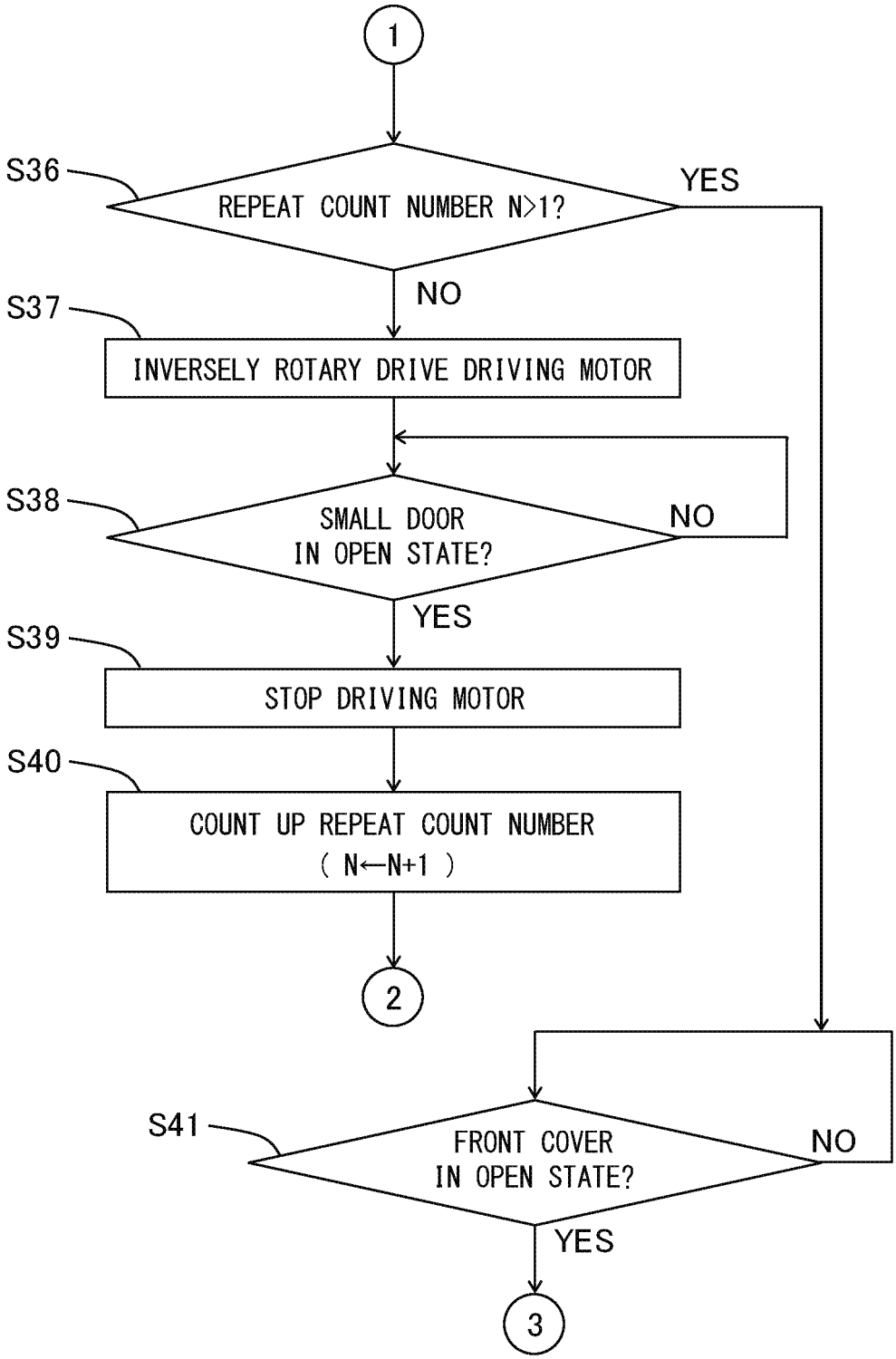
FIG. 24 is a second half of the flowchart showing the processing sequence to replace the toner container in the image forming apparatus according to the third embodiment.

FIGS. 23 and 24 are flowcharts showing a sequence of the processing to replace the toner container 110 in the third embodiment. In the control flow of the third embodiment, the CPU 401 defines a repeat count number N, and at a start of the flow N is set at zero (step S31). The CPU 401 monitors the small door opening/closing sensor 258 of the target station, and judges whether the small door 213 is brought from the open state to the closed state (step S32). In a case where the CPU 401 judges that the small door 213 is not in the closed state (NO at step S32), the CPU 401 performs the judgement again. In a case where the CPU 401 judges that the small door 213 is in the closed state (YES at step S32), the CPU 401 judges whether or not the toner container 110 is unattached (step S33). In a case where the CPU 401 judges that the toner container 110 is not unattached (NO at step S33), the CPU 401 ends the processing.

In a case where the CPU 401 judges that the toner container 110 is unattached (YES at step S33), the CPU 401 judges with the opening/closing detection sensor 271 whether or not the front cover 270 is in the open state (step S34). In a case where the CPU 401 judges with the opening/closing detection sensor 271 that the front cover 270 is not in the open state (NO at step S34), the CPU 401 displays the message informing the unattachment of the toner container 110 on the display panel 273 and ends the processing (step S35). In a case where the CPU 401 judges with the opening/closing detection sensor 271 that the front cover 270 is in the open state (YES at step S34), the CPU 401 judges whether or not the repeat count number is larger than a threshold value which is one (step S36). To be noted, although the threshold value of the repeat count number is set at one in this embodiment, it is not limited to this, and acceptable to set appropriately.

In a case where the CPU 401 judges that the repeat count number N is not greater than 1 (NO at step S36), the CPU 401 monitors the small door opening/closing sensor 258 of the target station, and judges whether or not the small door 213 is brought from the closed state to the open state (step S38). In a case where the CPU 401 judges that the small door 213 is not brought to the open state (NO at step S38), the CPU 401 performs the judgement again (step S38). In a case where the CPU 401 judges that the small door 213 is brought to the open state (YES at step S38), the CPU 401 stops the driving motor 252 (step S37). The CPU 401 count up the repeat count number N by 1 (step S40), and returns to the step S32. Having returned to the step S32, unless proceeding to NO at the step S33 or S34, the CPU 401 repeatedly returns to a branch step of the step S36, where the processing is branched based on the repeat count number N, with counting up the repeat count number N by 1 each time. The flow described above is repeated until the repeat count number N exceeds the threshold value.

In a case where the repeat count number N exceeds the threshold value (YES at step S36), the CPU 401 judges that the toner container 110 is unattached with the small door 213 being in the closed state. That is, although the toner container 110 is unattached and the small door 213 is in the closed state, in this condition the small door 213 is not brought to the open state. Thereafter, the CPU 401 judges with the opening/closing detection sensor 271 whether or not the front cover 270 is in the open state (step S41). In a case where the CPU 401 judges that the front cover 270 is not in the open state (NO at step S41), the CPU 401 performs the judgement again (step S41). In a case where the CPU 401 judges that the front cover 270 is brought to the open state (YES at step S41), the CPU 401 displays the message informing the unattachment of the toner container 110 (step S35) on the display panel 273, and ends the processing.

Accordingly, in this embodiment, the opening and closing of the small door 213 changes in a sequence of the opening, closing, and opening when N is equal to 0, and in a sequence of the opening, closing, and opening when N is equal to 1. When N becomes equal to 2, the opening and closing of the small door 213 starts with the opening and then changes to the closing. At this time, the CPU 401 holds the small door 213 in the closed state. Therefore, in a case where the CPU 401 detects that the small door 213 is in the closed state after twice repeated a switch between the open state and the closed state, the CPU 401 holds the small door 213 in the closed state. That is, in a case where the CPU 401 detects that the small door 213 is in the closed state after repeating the switch between the open state and the closed state, as an example of predetermined times, 4 times, the CPU 401 holds the small door 213 in the closed state.

In the above configuration, in a case where a movement to close the small door 213 is carried out a plurality of times (3 times in a case of this embodiment) with the toner container 110 unattached, the CPU 401 judges that the toner container 110 is intentionally unattached, and holds the small door 213 in the closed state. Herewith, it is possible to perform a recovery work which is required when the user closes the small door 213 with the toner container unattached by a mistake. Further, it is possible to intentionally hold the toner container 110 unattached in cases of such as moving the apparatus body 210 of the image forming apparatus 200 and using the image forming apparatus 200 in a color degeneration mode (such as monochrome only mode).

As described above, the image forming apparatus 200 of the third embodiment is able to address a case where the user wants to intentionally hold the toner container 110 unattached.

The present disclosure improves an operability at a time when the accommodating container of the developer is unattached.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-120819, filed Jun. 28, 2019 and No. 2020-070947, filed Apr. 10, 2020 which are hereby incorporated by reference herein in their entirety.

What is claimed is:

1. An image forming apparatus comprising:

an attachment portion to which a developer accommodating container configured to accommodate a developer is detachably attached;

an attachment detection unit configured to detect whether the developer accommodating container is attached to the attachment portion;

an output portion configured to output information of replacing the developer accommodating container;

a first cover disposed at the attachment portion and configured to be opened to an open state where the developer accommodating container is attachable to and detachable from the attachment portion and closed to a closed state where the developer accommodating container is not attachable to nor detachable from the attachment portion;

a first detection portion configured to detect the open state and the closed state of the first cover;

a second cover configured to be opened to an open state where the first cover is exposed in an openable and closable manner and closed to a closed state where the first cover is covered;

an opening unit configured to open the first cover from the closed state to the open state; and a control unit configured to control the opening unit to open the first cover linked with movement that the second cover is opened in a state the output portion outputs the information of replacing the developer accommodating container, wherein, after the first detection portion detects that the first cover is in the closed state after the first cover has been opened based on the information output by the output portion, the attachment detection unit detects whether the developer accommodating container is attached to the attachment portion or not, and in a case where the attachment detection unit detects that the developer accommodating container is not attached to the attachment portion, the control unit is configured to control the opening unit to open the first cover.

2. The image forming apparatus according to claim 1, wherein the attachment portion is one of a plurality of attachment portions, wherein the developer accommodating container is one of a plurality of developer accommodating containers disposed corresponding to the plurality of the attachment portions, wherein the first cover is one of a plurality of first covers disposed corresponding to the plurality of the attachment portions, wherein the second cover is configured to expose the plurality of the first covers in the open state and cover the plurality of the first covers in the closed state, and wherein the control unit is configured to control the opening unit to open only the first cover, among the plurality of first covers, corresponding to the attachment portion to which the developer accommodating container set as a target for replacement based on the information output by the output portion is attached.

3. The image forming apparatus according to claim 1, wherein the opening unit comprises an urging portion configured to urge the first cover in a direction in which the first cover is brought to the open state, and a locking unit configured to lock the first cover in the closed state, and wherein the control unit is configured to disengage a lock of the first cover in the closed state locked by the locking unit in a case where the first cover is brought to the open state.

4. The image forming apparatus according to claim 1, further comprising a second detection portion configured to detect the open state and the closed state of the second cover, wherein, in a case where the developer accommodating container attached to the attachment portion is set as a target for replacement based on the information output by the output portion, in a case where the second detection portion detects the open state of the second cover, the control unit is configured to control the opening unit to open the first cover.

5. The image forming apparatus according to claim 1, further comprising a display unit configured to display information in the image forming apparatus, wherein the control unit is configured to display information indicating an unattachment of the developer accommodating container to the attachment portion on the display unit in a case where the first cover is closed without attaching the developer accommodating container to the attachment portion.

6. An image forming apparatus comprising:

a developer accommodating container configured to be detachably attached to an apparatus body and accommodate a developer inside;

an attachment portion which is provided in the apparatus body and to which the developer accommodating container is attached;

a first cover configured to be opened to an open state where an opening portion of the attachment portion is opened and closed to a closed state where the opening portion is closed;

a first detection portion configured to detect an open state and a closed state of the first cover;

a driving unit configured to bring the first cover from the closed state to the open state;

an attachment detection unit configured to detect whether or not the developer accommodating container is attached to the attachment portion; and a control unit configured to control the driving unit to bring the first cover from the closed state to the open state in a case where the attachment detection unit detects an unattachment of the developer accommodating container to the attachment portion and the first detection portion detects that the first cover is in the closed state.

7. The image forming apparatus according to claim 6, further comprising a second cover configured to be opened to an open state where the first cover is exposed in an openable and closable manner and closed to a closed state where the first cover is covered; and a second detection portion configured to detect the open state and the closed state of the second cover, wherein, in a case where the attachment detection unit detects that the developer accommodating container is unattached to the attachment portion and the first detection portion detects that the first cover is in the closed state, in a case where the second detection portion detects that the second cover is in the closed state, the control unit is configured to maintain the first cover in the closed state.

8. The image forming apparatus according to claim 7, further comprising a display unit configured to display information in the image forming apparatus, wherein, in a case where the attachment detection unit detects that the developer accommodating container is unattached to the attachment portion and the second detection portion detects that the second cover is in the closed state, the control unit is configured to display information indicating the unattachment of the developer accommodating container to the attachment portion on the display unit.

9. The image forming apparatus according to claim 6, wherein, in a case where the attachment detection unit detected that the developer accommodating container was unattached to the attachment portion and the first detection portion detected that the first cover was in the closed state, in a case where the first detection portion detects that the first cover is in the closed state after the first cover has repeated a switch between the open state and the closed state by predetermined times, the control unit is configured to hold the first cover in the closed state.

10. The image forming apparatus according to claim 6, further comprising an output portion configured to output information of replacing the developer accommodating container, wherein, after the first cover has been opened according to the information output by the output portion, in a case where the first detection portion detects that the first cover is in the closed state and the attachment detection unit detects the unattachment of the developer accommodating container to the attachment portion, the control unit is configured to control the driving unit to open the first cover from the closed state to the open state.

11. The image forming apparatus according to claim 6, wherein the driving unit comprises an electric motor, further comprising a one-way clutch disposed on a power transmission path between the electric motor and the developer accommodating container, and wherein, in a case where the electric motor rotates in a first direction, the electric motor rotates the developer accommodating container so that the developer in the developer accommodating container is supplied to the apparatus body and, in a case where the electric motor rotates in a second direction opposite to the first direction, the electric motor brings the first cover from the closed state to the open state without rotating the developer accommodating container.

12. The image forming apparatus according to claim 6, further comprising:

a locking unit configured to be switched between a first position where the locking unit is possible to lock the first cover in the closed state and a second position where the locking unit is not possible to lock the first cover in the closed state;

a locking urging portion configured to urge the locking unit toward the first position;

a rotation shaft configured to be rotated by a driving force from the driving unit;

a cylindrical sleeve slidably disposed on a circumference of the rotation shaft, the rotation shaft being configured to relatively move in a rotational axis direction of the rotation shaft with respect to the sleeve, and, by a relative movement in the rotational axis direction, relative positions of the rotation shaft and the sleeve being switched between an engaging position where the rotation shaft and the sleeve engage each other and rotate integrally and a disengaging position where the rotation shaft and the sleeve does not engage each other and rotate idly; and an engagement portion disposed on a circumference of the sleeve, and configured to switch the locking unit from the first position to the second position by engaging with the locking unit, wherein, in a case where the first cover is in the closed state, the rotation shaft is at the engaging position, and, by driving the driving unit, the engagement portion is configured to switch the locking unit from the first position to the second position so that the first cover is unlockable in the closed state, and wherein, in a case where the first cover is in the open state, the rotation shaft is at the disengaging position and the locking urging portion is configured to switch the locking unit from the second position to the first position so that the first cover is lockable in the closed state.

13. The image forming apparatus according to claim 12, wherein the rotation shaft is configured to move in the rotational axis direction, further comprising a shaft urging portion configured to urge the rotation shaft toward the first cover in the rotational axis direction, and wherein, in a case where the engagement portion switches the locking unit from the first position to the second position, the shaft urging portion is configured to bring the first cover to the open state by moving the rotation shaft in the rotational axis direction.

14. The image forming apparatus according to claim 13, further comprising a first protrusion disposed on a circumferential surface of the rotation shaft and a second protrusion disposed on an inner circumferential surface of the sleeve, wherein the engagement portion is formed on a circumference of the sleeve protruding in a radial direction of the sleeve, wherein the engaging position is a position where the first protrusion and the second protrusion engage each other in a rotation direction, wherein the disengaging position is a position where the first protrusion and the second protrusion do not engage each other in the rotation direction, and wherein, in a case where the first cover is in the closed state, the rotation shaft is at the engaging position by pressing from the first cover, and, in a case where the first cover is in the open state, the rotation shaft is at the disengaging position by urging from the shaft urging portion.

15. The image forming apparatus according to claim 14, wherein the shaft urging portion is configured to urge the rotation shaft from the engaging position to the disengaging position, and wherein, in a case where the first cover is in the closed state, the shaft urging portion is configured to urge the rotation shaft to press the first cover in a direction to bring the first cover to the open state so that in a case where the engagement portion switches the locking unit from the first position to the second position, the first cover pressed by the rotation shaft opens to the open state.

16. The image forming apparatus according to claim 6, further comprising:

a locking unit configured to be switched between a first position where the locking unit is possible to lock the first cover in the closed state and a second position where the locking unit is not possible to lock the first cover in the closed state;

a locking urging portion configured to urge the locking unit toward the first position;

a rotation shaft configured to be rotated by a driving force from the driving unit and move in a rotational axis direction of the rotation shaft; and an engagement portion disposed on a circumference of the rotation shaft, and configured to be switched between an engaging position where the engagement portion engages with the locking unit and a disengaging position where the engagement portion does not engage with the locking unit and rotates idly, wherein, in a case where the first cover is in the closed state, the engagement portion is at the engaging position, and, by driving the driving unit, the engagement portion is configured to switch the locking unit from the first position to the second position so that the first cover is unlockable in the closed state, and wherein, in a case where the first cover is in the open state, the engagement portion is at the disengaging position, and the locking urging portion is configured to switch the locking unit from the second position to the first position so that the first cover is lockable in the closed state.

17. The image forming apparatus according to claim 16, further comprising a shaft urging portion configured to urge the rotation shaft toward the first cover by urging the rotation shaft from the engaging position to the disengaging position in the rotational axis direction, and wherein, in a case where the engagement portion switches the locking unit from the first position to the second position, the shaft urging portion is configured to bring the first cover to the open state by moving the rotation shaft in the rotational axis direction.

18. The image forming apparatus according to claim 16, the locking unit comprises:

a locking portion configured to engage with the first cover and lock the first cover in the closed state by engaging with the first cover;

an engaged portion configured to engage with the engagement portion and switch the locking unit from a locked state to an unlocked state by engaging with the engagement portion; and a swing shaft configured to swing the locking unit around a direction perpendicularly intersecting with the rotational axis direction.

19. The image forming apparatus according to claim 16, wherein the rotational axis direction is along an insert direction to insert the developer accommodating container into the attachment portion, and wherein, with respect to the insert direction, the first cover is disposed upstream of the attachment portion and the driving unit is disposed downstream of the attachment portion.

20. The image forming apparatus according to claim 6, wherein the driving unit comprises a solenoid.

21. An image forming apparatus comprising:

an image bearing member on which an electrostatic image is born;

a developing unit configured to develop the electrostatic image born on the image bearing member by using a developer including toner;

a toner accommodating container configured to accommodate the toner to supply to the developing unit;

an attachment portion to which the toner accommodating container is attached;

a first cover configured to be opened to an open state and closed to a closed state where the first cover covers the toner accommodating container attached to the attachment portion;

wherein in a case where the toner accommodating container is not attached to the attachment portion and the first cover is in the open state, the toner accommodating container is capable of being attached to the attachment portion, and wherein in a case where the first cover is in the closed state, the toner accommodating container is not capable of being attached to the attachment portion, a second cover configured to be opened to an open state where the first cover is exposed in an openable and closable manner and closed to a closed state where the first cover is covered;

an opening unit configured to open the first cover; and a control unit, wherein in a case where the first cover is in the closed state, the second cover is in the closed state, the toner accommodating container is attached to the attachment portion, and it is detected that a quantity of the toner accommodated in the toner accommodating container is less than a predetermined quantity, the control unit is configured to control the opening unit to open the first cover linked with movement to open the second cover from the closed state to the open state, and wherein after the control unit controls the opening unit to open the first cover linked with movement to open the second cover from the closed state to the open state, in a case where the first cover is in the open state and the second cover is in the open state, the control unit is configured to control the opening unit to open the first cover linked with movement to close the first cover from the open state to the closed state in a state that a toner accommodating container is not attached to the attachment portion.

22. The image forming apparatus according to claim 21, wherein the opening unit includes:

a driving device;

a driving gear configured to drivingly rotate in a first rotation direction or a second rotation direction opposite to the first rotation direction by changing a driving direction of the driving device; and a rotating shaft configured to receive a driving force, wherein the opening unit opens the first cover as the shaft is drivingly rotated in a predetermined direction by receiving the driving force, and wherein in a state that the toner accommodating container is attached to the attachment portion, in a case where the driving gear is drivingly rotated in the first rotation direction, the opening unit does not input the driving force transmitted through the driving gear to the shaft, and in a state that the toner accommodating container is attached to the attachment portion, in a case where the driving gear is drivingly rotated in the second rotation direction, the opening unit changes a state in which the driving force is input to the shaft so that the driving force transmitted through the driving gear is input to the shaft.

23. The image forming apparatus according to claim 22, wherein the toner accommodating container is configured to rotate and includes an input gear configured to receive a driving force, and wherein in a state that the toner accommodating container is attached to the attachment portion, in a case where the driving gear is drivingly rotated in the first rotation direction, the toner accommodating container is drivingly rotated in a third direction by receiving the driving force transmitted through the driving gear to the input gear so that the toner accommodated in the toner accommodating container is discharged from the toner accommodating container, and in a state that the toner accommodating container is attached to the attachment portion, in a case where the driving gear is drivingly rotated in the second rotation direction, the toner accommodating container is drivingly rotated in a fourth direction opposite to the third direction by receiving the driving force transmitted through the driving gear to the input gear.

24. The image forming apparatus according to claim 22, further comprising:

an opening/closing detection portion configured to detect that the first cover is in the open state, wherein in a case where the control unit detects that the quantity of the toner accommodated in the toner accommodating container is less than the predetermined quantity, the control unit is configured to control the driving device such that the driving gear is drivingly rotated in the second rotation direction until the opening/closing detection portion detects that the first cover is in the open state.

25. The image forming apparatus according to claim 21, further comprising:

a toner quantity detection portion configured to detect information of a quantity of the toner accommodated in the toner accommodating container; and a display portion configured to display information indicating that replacement of the toner accommodating container is needed in a case where the toner quantity detection portion detects that the quantity of the toner accommodated in the toner accommodating container is less than the predetermined quantity.

26. The image forming apparatus according to claim 21, further comprising:

an attachment detection portion configured to detect that the toner accommodating container is attached to the attachment portion, a display portion configured to display information indicating that the toner accommodating container is not attached to the attachment portion in a case where the attachment detection portion does not detect that the toner accommodating container is attached to the attachment portion.

27. An image forming apparatus comprising:

an image bearing member on which an electrostatic image is born;

a developing unit configured to develop the electrostatic image born on the image bearing member by using a developer including toner;

a toner accommodating container configured to accommodate the toner to supply to the developing unit;

an attachment portion to which the toner accommodating container is attached;

a first cover configured to be opened to an open state and closed to a closed state; and a second cover configured to be opened to an open state where the first cover is exposed in an openable and closable manner and closed to a closed state where the first cover is covered;

wherein in a case where the toner accommodating container is not attached to the attachment portion, the first cover is in the open state, and the second cover is in the open state, an attaching operation attaching the toner accommodating container to the attachment portion is performable, wherein in a case where the toner accommodating container is not attached to the attachment portion, the first cover is in the closed state, and the second cover is in the open state, the attaching operation attaching the toner accommodating container to the attachment portion is not performable, wherein in a case where the toner accommodating container is attached to the attachment portion, a quantity of the toner accommodated in the toner accommodating container is less than a predetermined quantity, and the second cover is in the open state, the first cover is in the open state, and wherein in a case where the toner accommodating container is attached to the attachment portion, the quantity of the toner accommodated in the toner accommodating container is less than the predetermined quantity, the first cover is in the open state, and the second cover is in the open state, if the toner accommodating container is detached from the attachment portion by a user and then the first cover is closed by the user in a state a toner accommodating container is not attached to the attachment portion, the first cover is opened so as to be changed from the closed state to the open state.

28. The image forming apparatus according to claim 27, further comprising:

a driving device;

a driving gear configured to drivingly rotate in a first rotation direction or a second rotation direction opposite to the first rotation direction by changing a driving direction of the driving device; and a rotating shaft configured to receive a driving force, wherein in a state that the toner accommodating container is attached to the attachment portion, in a case where the driving gear is drivingly rotated in the first rotation direction, the driving force transmitted through the driving gear is not input to the shaft, and wherein in a state that the toner accommodating container is attached to the attachment portion, in a case where the driving gear is drivingly rotated in the second rotation direction, the driving force transmitted through the driving gear is input to the shaft, and the first cover is opened so as to be changed from the closed state to the open state as the shaft is drivingly rotated in a predetermined direction by receiving the driving force.

29. The image forming apparatus according to claim 28, wherein the toner accommodating container is configured to rotate and includes an input gear configured to receive a driving force, and wherein in a state that the toner accommodating container is attached to the attachment portion, in a case where the driving gear is drivingly rotated in the first rotation direction, the toner accommodating container is drivingly rotated in a third direction by receiving the driving force transmitted through the driving gear to the input gear so that the toner accommodated in the toner accommodating container is discharged from the toner accommodating container, and in a state that the toner accommodating container is attached to the attachment portion, in a case where the driving gear is drivingly rotated in the second rotation direction, the toner accommodating container is drivingly rotated in a fourth direction opposite to the third direction by receiving the driving force transmitted through the driving gear to the input gear.

30. The image forming apparatus according to claim 28, further comprising:

an opening/closing detection portion configured to detect that the first cover is in the open state, and a control unit, wherein in a case where the quantity of the toner accommodated in the toner accommodating container is less than the predetermined quantity, the control unit is configured to control the driving device such that the driving gear is drivingly rotated in the second rotation direction until the opening/closing detection portion detects that the first cover is in the open state.

31. The image forming apparatus according to claim 27, further comprising:

a toner quantity detection portion configured to detect information of a quantity of the toner accommodated in the toner accommodating container; and a display portion configured to display information indicating that replacement of the toner accommodating container is needed in a case where the toner quantity detection portion detects that the quantity of the toner accommodated in the toner accommodating container is less than the predetermined quantity.

32. The image forming apparatus according to claim 27, further comprising:

an attachment detection portion configured to detect that the toner accommodating container is attached to the attachment portion, a display portion configured to display information indicating that the toner accommodating container is not attached to the attachment portion in a case where the attachment detection portion does not detect that the toner accommodating container is attached to the attachment portion.

33. An image forming apparatus comprising:

an image bearing member on which an electrostatic image is born;

a developing unit configured to develop the electrostatic image born on the image bearing member by using a developer including toner;

a toner accommodating container configured to accommodate the toner to supply to the developing unit;

an attachment portion to which the toner accommodating container is attached;

a first cover configured to be opened to an open state and closed to a closed state; and a second cover configured to be opened to an open state where the first cover is exposed in an openable and closable manner and closed to a closed state where the first cover is covered;

wherein in a case where the toner accommodating container is not attached to the attachment portion, the first cover is in the open state, and the second cover is in the open state, an attaching operation attaching the toner accommodating container to the attachment portion is performable, wherein in a case where the toner accommodating container is not attached to the attachment portion, the first cover is in the closed state, and the second cover is in the open state, the attaching operation attaching the toner accommodating container to the attachment portion is not performable, a locking unit configured to lock the first cover in the closed state, wherein in a case where locking of the first cover by the locking unit is in an unlocked state and the second cover is in the open state, the first cover is in the open state, wherein in a case where the toner accommodating container is attached to the attachment portion and a quantity of the toner accommodated in the toner accommodating container is less than a predetermined quantity, the locking of the first cover by the locking unit is in the unlocked state, wherein in a case where the toner accommodating container is attached to the attachment portion, the quantity of the toner accommodated in the toner accommodating container is less than the predetermined quantity, the first cover is in the open state, and the second cover is in the open state, if the toner accommodating container is detached from the attachment portion by a user and then the first cover is closed by the user in a state a toner accommodating container is not attached to the attachment portion, the first cover is opened so as to be changed from the closed state to the open state.

34. The image forming apparatus according to claim 33, further comprising:

a driving device;

a driving gear configured to drivingly rotate in a first rotation direction or a second rotation direction opposite to the first rotation direction by changing a driving direction of the driving device; and a rotating shaft configured to receive a driving force, wherein in a state that the toner accommodating container is attached to the attachment portion, in a case where the driving gear is drivingly rotated in the first rotation direction, the driving force transmitted through the driving gear is not input to the shaft, and wherein in a state that the toner accommodating container is attached to the attachment portion, in a case where the driving gear is drivingly rotated in the second rotation direction, the driving force transmitted through the driving gear is input to the shaft, and the locking of the first cover by the locking unit is in the unlocked state as the shaft is drivingly rotated in a predetermined direction by receiving the driving force.

35. The image forming apparatus according to claim 34, wherein the toner accommodating container is configured to rotate and includes an input gear configured to receive a driving force, and wherein in a state that the toner accommodating container is attached to the attachment portion, in a case where the driving gear is drivingly rotated in the first rotation direction, the toner accommodating container is drivingly rotated in a third direction by receiving the driving force transmitted through the driving gear to the input gear so that the toner accommodated in the toner accommodating container is discharged from the toner accommodating container, and in a state that the toner accommodating container is attached to the attachment portion, in a case where the driving gear is drivingly rotated in the second rotation direction, the toner accommodating container is drivingly rotated in a fourth direction opposite to the third direction by receiving the driving force transmitted through the driving gear to the input gear.

36. The image forming apparatus according to claim 34, further comprising:

an opening/closing detection portion configured to detect that the first cover is in the open state, and a control unit, wherein in a case where the quantity of the toner accommodated in the toner accommodating container is less than the predetermined quantity, the control unit is configured to control the driving device such that the driving gear is drivingly rotated in the second rotation direction until the opening/closing detection portion detects that the first cover is in the open state.

37. The image forming apparatus according to claim 33, further comprising:

a toner quantity detection portion configured to detect information of a quantity of the toner accommodated in the toner accommodating container; and a display portion configured to display information indicating that replacement of the toner accommodating container is needed in a case where the toner quantity detection portion detects that the quantity of the toner accommodated in the toner accommodating container is less than the predetermined quantity.

38. The image forming apparatus according to claim 33, further comprising:

an attachment detection portion configured to detect that the toner accommodating container is attached to the attachment portion; and a display portion configured to display information indicating that the toner accommodating container is not attached to the attachment portion in a case where the attachment detection portion does not detect that the toner accommodating container is attached to the attachment portion.

39. An image forming apparatus comprising:

an image bearing member on which an electrostatic image is born;

a developing unit configured to develop the electrostatic image born on the image bearing member by using a developer including toner;

a toner accommodating container configured to accommodate the toner to supply to the developing unit;

an attachment portion to which the toner accommodating container is attached; and a cover configured to be opened to an open state and closed to a closed state;

wherein in a case where the toner accommodating container is not attached to the attachment portion and the cover is in the open state, an attaching operation attaching the toner accommodating container to the attachment portion is performable, wherein in a case where the toner accommodating container is not attached to the attachment portion and the cover is in the closed state, the attaching operation attaching the toner accommodating container to the attachment portion is not performable, wherein in a case where the toner accommodating container is attached to the attachment portion and a quantity of the toner accommodated in the toner accommodating container is less than a predetermined quantity, the cover is in the open state, and wherein in a case where the toner accommodating container is attached to the attachment portion, the quantity of the toner accommodated in the toner accommodating container is less than the predetermined quantity, and the cover is in the open state, if the toner accommodating container is detached from the attachment portion by a user and then the cover is closed by the user in a state a toner accommodating container is not attached to the attachment portion, the cover is opened so as to be changed from the closed state to the open state.

40. The image forming apparatus according to claim 39, further comprising:

a further image bearing member on which an electrostatic image is born;

a further developing unit configured to develop the electrostatic image born on the further image bearing member by using a developer including toner;

a further toner accommodating container configured to accommodate the toner to supply to the further developing unit;

a further attachment portion to which the further toner accommodating container is attached; and a further cover configured to be opened to an open state and closed to a closed state;

wherein in a case where the further toner accommodating container is not attached to the further attachment portion and the further cover is in the open state, an attaching operation attaching the further toner accommodating container to the further attachment portion is performable, wherein in a case where the further toner accommodating container is not attached to the further attachment portion and the further cover is in the closed state, the attaching operation attaching the further toner accommodating container to the further attachment portion is not performable, wherein in a case where the further toner accommodating container is attached to the further attachment portion and a quantity of the toner accommodated in the further toner accommodating container is less than a predetermined quantity, the further cover is in the open state, and wherein in a case where the further toner accommodating container is attached to the further attachment portion, the quantity of the toner accommodated in the further toner accommodating container is less than the predetermined quantity, and the further cover is in the open state, if the further toner accommodating container is detached from the further attachment portion by a user and then the further cover is closed by the user in a state a further toner accommodating container is not attached to the further attachment portion, the further cover is opened so as to be changed from the closed state to the open state.

41. The image forming apparatus according to claim 39, further comprising:

a driving device;

a driving gear configured to drivingly rotate in a first rotation direction or a second rotation direction opposite to the first rotation direction by changing a driving direction of the driving device; and a rotating shaft configured to receive a driving force, wherein in a state that the toner accommodating container is attached to the attachment portion, in a case where the driving gear is drivingly rotated in the first rotation direction, the driving force transmitted through the driving gear is not input to the shaft, and wherein in a state that the toner accommodating container is attached to the attachment portion, in a case where the driving gear is drivingly rotated in the second rotation direction, the driving force transmitted through the driving gear is input to the shaft, and the cover is opened so as to be changed from the closed state to the open state as the shaft is drivingly rotated in a predetermined direction by receiving the driving force.

42. The image forming apparatus according to claim 41, wherein the toner accommodating container is configured to rotate and includes an input gear configured to receive a driving force, and wherein in a state that the toner accommodating container is attached to the attachment portion, in a case where the driving gear is drivingly rotated in the first rotation direction, the toner accommodating container is drivingly rotated in a third direction by receiving the driving force transmitted through the driving gear to the input gear so that the toner accommodated in the toner accommodating container is discharged from the toner accommodating container, and in a state that the toner accommodating container is attached to the attachment portion, in a case where the driving gear is drivingly rotated in the second rotation direction, the toner accommodating container is drivingly rotated in a fourth direction opposite to the third direction by receiving the driving force transmitted through the driving gear to the input gear.

43. The image forming apparatus according to claim 41, further comprising:

an opening/closing detection portion configured to detect that the cover is in the open state, and a control unit, wherein in a case where the quantity of the toner accommodated in the toner accommodating container is less than the predetermined quantity, the control unit is configured to control the driving device such that the driving gear is drivingly rotated in the second rotation direction until the opening/closing detection portion detects that the cover is in the open state.

44. The image forming apparatus according to claim 39, further comprising:

a toner quantity detection portion configured to detect information of a quantity of the toner accommodated in the toner accommodating container; and a display portion configured to display information indicating that replacement of the toner accommodating container is needed in a case where the toner quantity detection portion detects that the quantity of the toner accommodated in the toner accommodating container is less than the predetermined quantity.

45. The image forming apparatus according to claim 39, further comprising:

an attachment detection portion configured to detect that the toner accommodating container is attached to the attachment portion, a display portion configured to display information indicating that the toner accommodating container is not attached to the attachment portion in a case where the attachment detection portion does not detect that the toner accommodating container is attached to the attachment portion.

* * * * *